US009689095B2

(12) United States Patent
Lonati et al.

(10) Patent No.: US 9,689,095 B2
(45) Date of Patent: Jun. 27, 2017

(54) MOBILE CAM DEVICE FOR COMMANDING NEEDLES OF A NEEDLE BED OF A KNITTING MACHINE

(71) Applicant: SANTONI S.P.A., Brescia (IT)

(72) Inventors: Tiberio Lonati, Brescia (IT); Ettore Lonati, Botticino (IT); Fausto Lonati, Brescia (IT)

(73) Assignee: SANTONI S.P.A., Brescia (IT)

( * ) Notice: Subject to any disclaimer, the term of this patent is extended or adjusted under 35 U.S.C. 154(b) by 0 days.

(21) Appl. No.: 14/892,500

(22) PCT Filed: May 15, 2014

(86) PCT No.: PCT/IB2014/061465
§ 371 (c)(1),
(2) Date: Nov. 19, 2015

(87) PCT Pub. No.: WO2014/188315
PCT Pub. Date: Nov. 27, 2014

(65) Prior Publication Data

US 2016/0102423 A1 Apr. 14, 2016

(30) Foreign Application Priority Data

May 20, 2013 (IT) ..... BS2013A0071

(51) Int. Cl.
*D04B 15/68* (2006.01)
*D04B 15/78* (2006.01)
(Continued)

(52) U.S. Cl.
CPC ..... *D04B 15/78* (2013.01); *D04B 15/32* (2013.01); *D04B 15/68* (2013.01); *D04B 15/82* (2013.01)

(58) Field of Classification Search
CPC ..... D04B 15/75; D04B 15/32; D04B 15/68; D04B 15/82
See application file for complete search history.

(56) References Cited

U.S. PATENT DOCUMENTS 3,683,644 A * 8/1972 Chvala ..... D04B 15/78 66/40
4,099,390 A * 7/1978 Vinas ..... D04B 15/78 66/219

(Continued)

FOREIGN PATENT DOCUMENTS

EP 2 402 492 A1 1/2012
TW 511 664 U 11/2002

*Primary Examiner* — Danny Worrell
(74) *Attorney, Agent, or Firm* — Pearne & Gordon LLP

(57) ABSTRACT

A mobile cam device (1) for commanding needles of a needle bed of a knitting machine, the device comprising a body (2) of the device provided with at least a first housing seating (4*a*) having a longitudinal development and configured to movably house at least a first actuator (5*a*) in the body. The device further comprises at least a first command cam (8*a*) movably mounted and associated to the body and destined to interact with at least a needle of a needle bed of a knitting machine, and at least a first actuator (5*a*), movably housed at least partially in the first housing seating (4*a*) in the body and destined to move in a controlled way the first command cam (8*a*). The first actuator comprises a first piston (15*a*) and a second piston (16*a*) distinct from one another and translatably housed in the first seating, the first and second piston being arranged in series along the longitudinal extension of the first seating and being translatable independently with respect to one another. The body (2) of the device is one and one alone, and is made in a single piece.

20 Claims, 9 Drawing Sheets

(51) Int. Cl.
*D04B 15/82* (2006.01)
*D04B 15/32* (2006.01)

(56) References Cited

U.S. PATENT DOCUMENTS 5,187,951 A 2/1993 Stroud et al.
5,222,380 A * 6/1993 Lonati ..... D04B 15/00
66/134
5,802,877 A 9/1998 Yates et al.

* cited by examiner

FIG.2
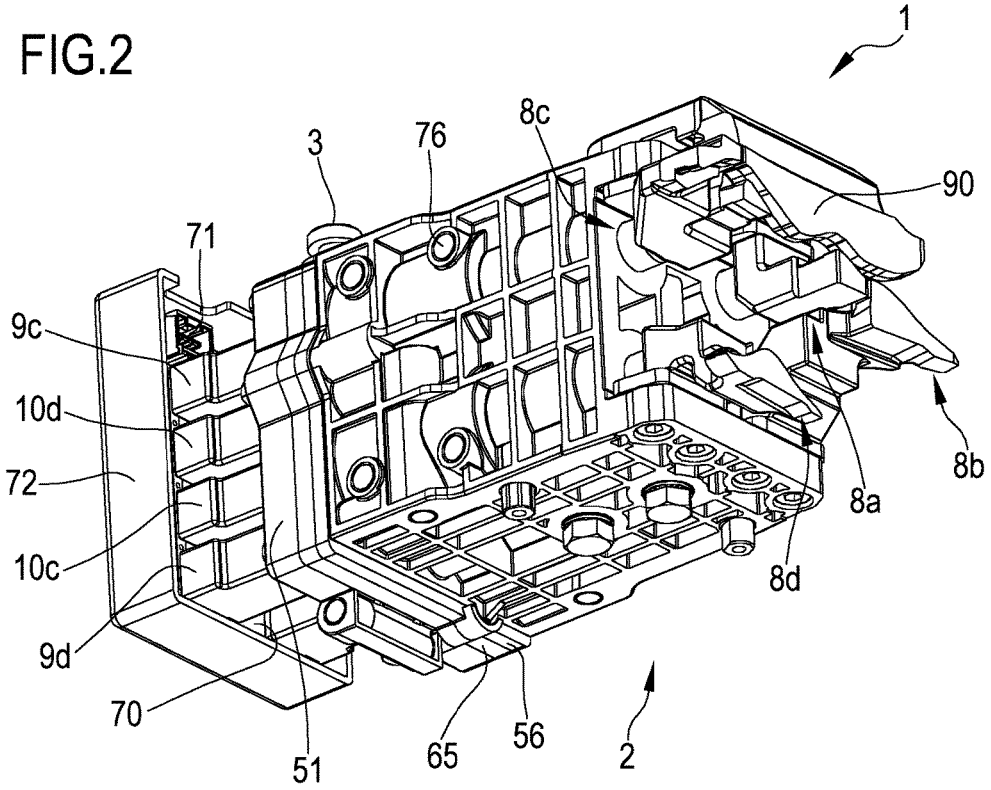
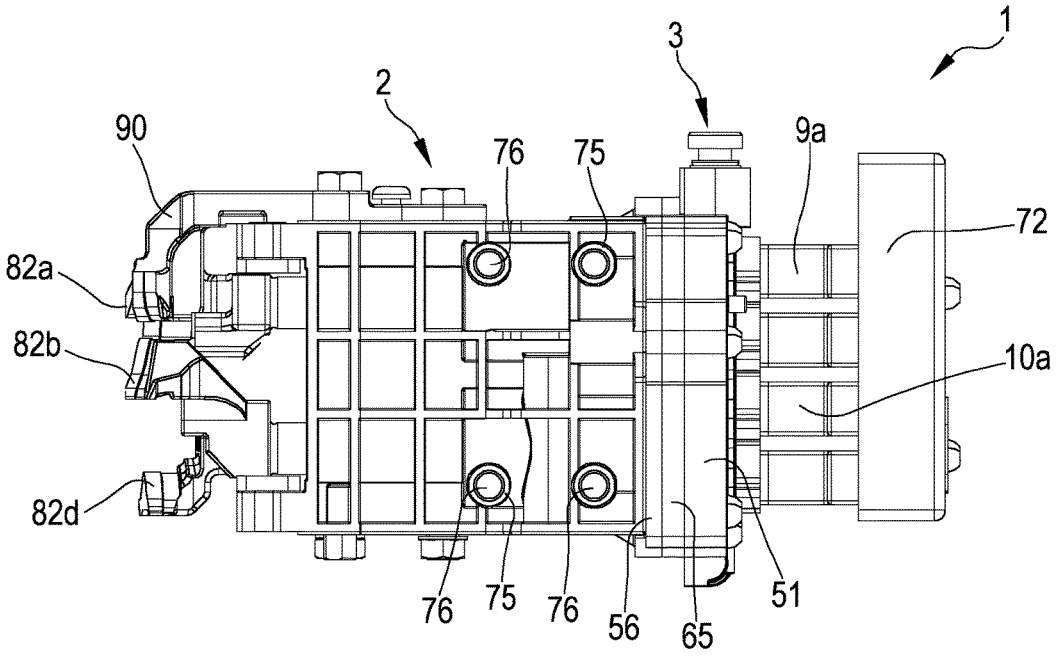
FIG.3

FIG.7
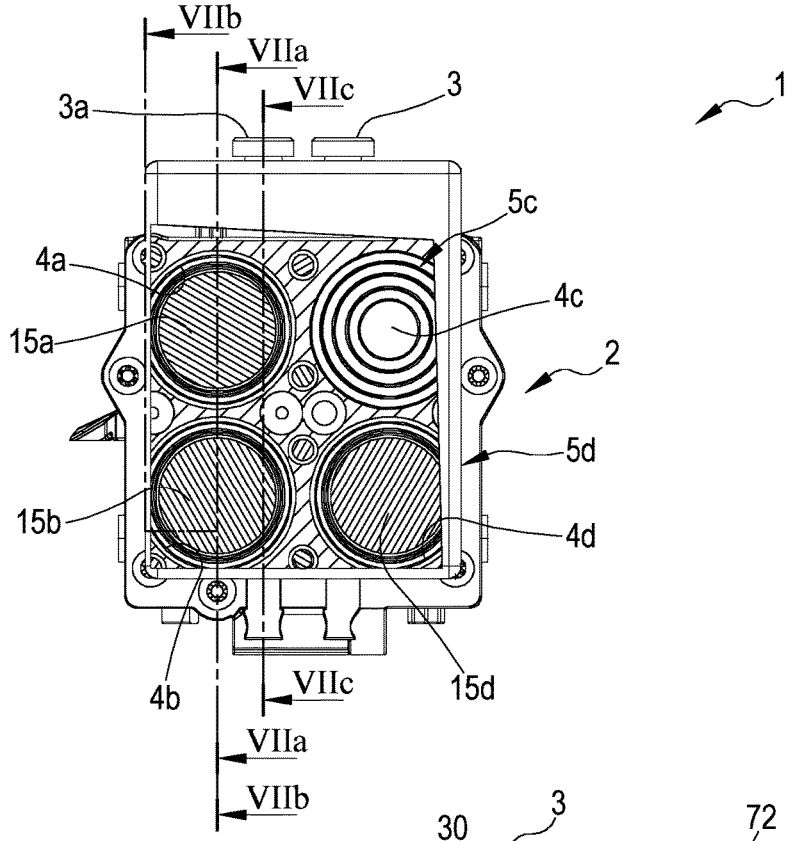
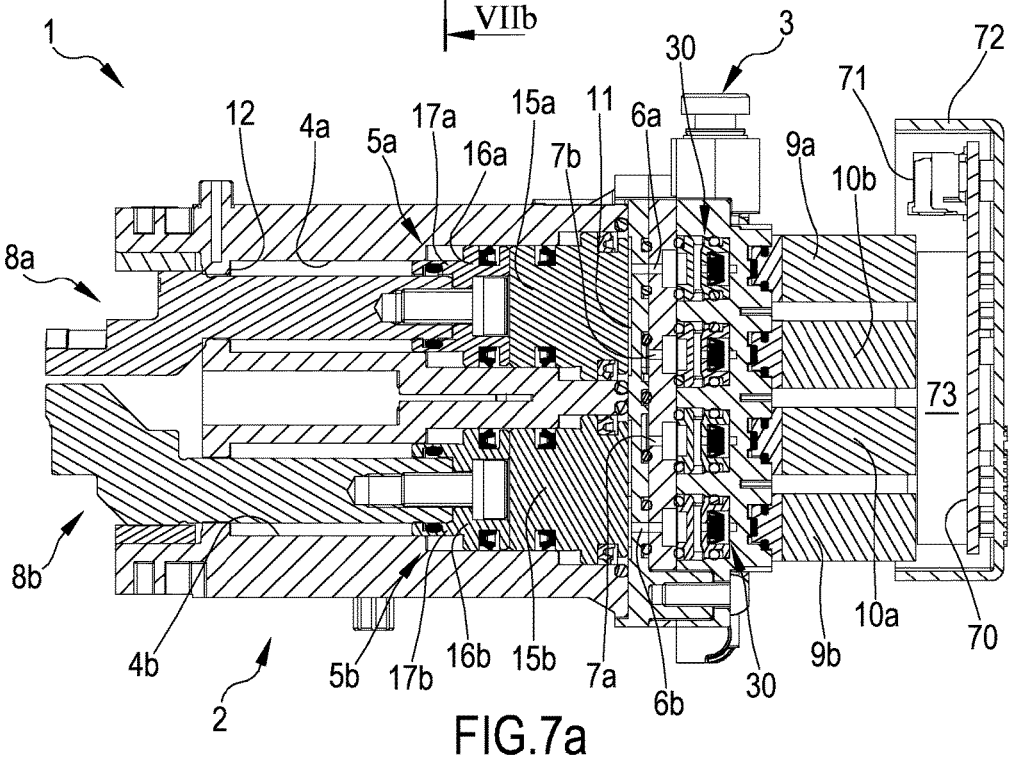
FIG.7a

MOBILE CAM DEVICE FOR COMMANDING NEEDLES OF A NEEDLE BED OF A KNITTING MACHINE

The present invention relates to a device for commanding needles of a needle bed of a knitting machine. In greater detail, the present invention relates to the technical sector of knitting machines for knitwear, seamless knitwear, hosiery and the like, in particular circular knitting machines.

As is known, knitting machines are provided with a plurality of needles which cooperate with a set of threads for forming a knitted textile; reference is particularly made to needles of a rotating cylinder of a circular knitting machine. The knitting machines are provided with command devices able to act on the needles in such a way that they cooperate in a desired way with the threads for the formation of a determined stitch having determined characteristics.

The command devices comprise command cams (known in the sector as needle cams) active on one or more needles of the machine such as to take them at least between a deactivated position, in which they do not interact with the threads, and an active position, in which the needles interact with one or more threads for working and forming the knitting stitch.

In substance, the command device moves in a controlled way, using appropriate actuators, the command cams so that the needles are active or not on the threads. The actuators are typically fluid-dynamic actuators, in particular pneumatic actuators or pistons, supplied with compressed air so as to translate to and fro and consequently to move the command cams nearingly and distancingly to the rotating cylinder such as to activate and deactivate the needles during the formation of the knitting.

A knitting machine typically comprises a plurality of command devices, arranged about the rotating cylinder such as to command the movement of a plurality, and preferably all, the needles of the cylinder.

In known machines, the control of each of the command devices is achieved by means of an electronic control unit arranged in a special section of the machine, for example a cabin or box or switchboard or command console. The electronic control unit comprises a plurality of solenoid valves, each of which is tasked to command the functioning of a single actuator internally of a command device. Typically, in known machines, the solenoid valves for the control of the command devices are joined in single blocks incorporating a plurality (for example eight, sixteen etc.) of solenoid valves and connected to the control unit.

Further, each actuator internally of the command device requires supply with compressed air; to this end, the machine comprises an assembly of tubes which start from a single source of compressed air (for example a tank) and singly reach a respective actuator; therefore to a determined number of actuators present in the command devices corresponds an equal number of tubes of compressed air which are singly dedicated. To enable control of the supplies of compressed air to the actuators, in known machines each solenoid valve is active on a respective air supply tube, with the aim of enabling or preventing passage of air towards an actuator, respectively to activate or deactivate it.

In the known machines each command device typically comprises two actuators able independently to command two command cams; in this configuration the device is also known in the sector with the term dual cam; by flanking a determined number of dual cams the fall of stitches from the knitting machine can be configured. Each dual cam therefore requires two air supply tubes and two or more solenoid valves located in the command unit to command functioning of the actuators.

The Applicant has found that the known devices for commanding needles and other mobile knitting machine organs are not without drawbacks and can be improved in various ways, in particular with reference to the performances attainable with the devices and the integration thereof in knitting machines.

A typical drawback of the known devices is the need to destine a single dedicated supply tube of the compressed air for each actuator of the device. Remembering that numerous command devices are present in a knitting machine, each with a plurality of actuators, it is an extremely complex machine due to the high number of compressed-air tubes located along the whole machine, from the source of compressed air (single for the whole machine) towards all the actuators. This significantly increases design costs, costs for pneumatic cabling, maintenance of the knitting machine; further, the setting-up of the known knitting machines is greatly susceptible to mounting errors, and the functioning is subject to faults and/or malfunctioning.

A further drawback of the known solutions is that they require frequent and expensive cleaning interventions on the pneumatic plant, as the numerous and long air supply tubes are subject to clogging phenomena and accumulation of impurities; the lack of or incomplete maintenance of the pneumatic plant can cause faults or malfunctioning of the actuators of the device or in the command cams.

A further drawback of the known devices, encountered by the Applicant, is the slow and/or not optimal control of the movement of the command cams, due to the limits of activation of the actuators in the known devices. In fact, control of the single actuators by the solenoid valves located in the central command unit of the knitting machine (each active on a single air supply tube for an actuator) requires long times, as the passage of the solenoid valve between the open condition of the supply tube (to activate the corresponding actuator) and the closed condition of the tube (to deactivate the actuator) in each case is subject to a delay in actuator response, due to the distance between the solenoid valve and the respective actuator and to the length of the supply tube from the solenoid valve to the actuator. In other words, the overall velocity of processing and carrying out the control of the known devices is limited by the structure of the devices and the arrangement thereof internally of the knitting machine. For this reason the performances obtainable by the known command devices are limited, as beyond a certain limit it is no longer possible to increase the activation velocity (activation/deactivation) of the actuators by the solenoid valves, as the compressed-air supply connections (which actuate the actuators) would be unable to switch the passage between the activation and deactivation conditions of the actuators at the required velocity.

In known-type circular knitting machines, for example, this limitation of performance is translated into a limit in the rotation velocity of the knitting machine (and therefore a limit to the amount of knitting produced per time unit): in fact, typically it is technically impossible to move the actuators in a time corresponding to a portion of rotation of the cylinder, and thus it is not possible to bring the cylinder to a rotation velocity that is such as to require the switching of the actuators in a shorter time than the minimum response time imposed by the pneumatic connections.

It is worthy of consideration that the configuration of known knitting machines, which, as described above, require complex pneumatic supply connections from the command unit of the machine, where the solenoid valves are located, to the single actuators, is necessary because there are oil, dust and other impurities present in the zone of the machine where the needle cam command devices operate. This drawback requires that command of passage/non-passage of compressed air from the control source to each of the actuators of the command devices is done at a distance from the actual device, so that the control part and the inside of the actuators are not contaminated by oil and other impurities.

In this situation, the aim underpinning the present invention, in its various aspects and/or embodiments, is to provide a mobile cam device for commanding needles of a needle bed of a knitting machine which can obviate one or more of the cited drawbacks.

A further aim of the present invention is to disclose a mobile cam device for commanding needles of a needle bed of a knitting machine characterised by a simple and rational structure.

A further aim of the present invention is to provide a mobile cam device able to improve the performance of a knitting machine, in particular increasing the knitting productivity of the machine, for example in terms of quantity of knitting produced in a time unit and/or complexity of the knitting produced.

A further aim of the present invention is to provide a mobile cam device for circular knitting machines able to increase a maximum velocity reachable by the rotating cylinder bearing the needles.

A further aim of the present invention is to provide a mobile cam device for commanding needles of a needle bed of a knitting machine enabling a more efficient and effective control of the needles of the machine.

A further aim of the present invention is to provide a mobile cam device for commanding needles of a needle bed of a knitting machine able to keep the pneumatic circuit of the machine clean in a way that is simple and effective.

A further aim of the present invention is to provide a mobile cam device for commanding needles of a needle bed of a knitting machine able to reduce the need for maintenance of the device and to the whole knitting machine.

A further aim of the present invention is to provide a mobile cam device for commanding needles of a needle bed of a knitting machine characterised by a significant duration over time and/or being more resistant to faults or malfunctioning.

A further aim of the present invention is to provide a mobile cam device for commanding needles of a needle bed of a knitting machine having a versatile structure, easily adaptable to the various types of knitting machines and/or production needs.

A further aim of the present invention is to remedy the above-mentioned drawback of the presence of oil and dirt in the point where the cam command devices operate, by providing a novel device which can operate efficiently in those conditions.

A further aim of the present invention is to provide a mobile cam device for commanding needles of a needle bed of a knitting machine characterised by a modest manufacturing cost with respect to the performance and quality offered and/or by a high degree of ease of mounting and/or setting-up and/or maintenance.

These aims and others besides, which will better emerge during the course of the following description, are substantially attained by a mobile cam device for commanding needles of a needle bed of a knitting machine according to one or more of the appended claims, each of which can be taken alone (without the relative dependencies) or in any combination with the other claims, as well as the following aspects and/or embodiments, variously combined, also with the above-mentioned claims.

In a first aspect, the invention relates to a mobile cam device for commanding needles of a needle bed of a knitting machine, the device comprising:

- at least a body having at least an air inlet destined to be connected to a source of compressed air, at least a housing seating for movably housing at least a first actuator in the body, and having at least a first air pathway defined internally of the body and connecting the at least an air inlet with the first seating for moving the actuator by means of the compressed air;
- at least a first command cam movably mounted and associated to the body and destined to interact with at least a needle of a needle bed of a knitting machine;
- at least a first actuator, movably housed at least partially in the first housing seating in the body and destined to controllingly move the first command cam.

In an aspect the device comprises at least at least a first solenoid valve mounted and connected directly to the body of the device and active directly at least on the first air pathway, the first solenoid valve being configured and predisposed to selectively enable or prevent passage of air to in the first air pathway such as to selectively activate the first actuator.

In an aspect the first seating is provided with a first bottom end connected to the first air pathway and a second head end, opposite the bottom end, in which it is partially insertable, or at which an engaging portion of a first command cam is associable to the actuator, such that an operating portion of the cam exits from the first seating and from the body in order to cooperate with one or more needles of a needle bed of a knitting machine.

In an aspect the first actuator comprises a first piston translatable selectively in the first seating at least between a first position in which it is retracted in the seating at the bottom end, preferably abuttingly on a surface of the bottom end, preferably abutting on a surface of the bottom end, and a second position in which it is advanced in the first seating towards the head end.

In an aspect, in the first position of the first piston the first solenoid valve calve prevents passage of the air in the first air pathway and in the second position the first solenoid valve enables passage of air in the first air pathway.

In an aspect the body comprises a second air pathway, defined internally of the body and connecting the at least an air inlet or a further air inlet with the first seating in a point downstream of the first piston, and a second solenoid valve mounted and connected directly to the body and active directly on the second air pathway, the second solenoid valve being configured and predisposed to selectively enable or prevent passage of air into the second air pathway.

In an aspect the first actuator comprises a second piston housed in the first seating in series to the first piston, i.e. downstream of the first piston with respect to a longitudinal development of the first seating of the bottom end to the head end, the second piston being selectively translatable in the first seating at least between a respective first position in which it is retracted in the seating and headed abuttingly on a head surface of the first piston, and a respective second position in which it is advanced in the first seating with respect to the head surface of the first piston towards the head end.

In an aspect, in the first position of the second piston the second solenoid valve prevents passage of the air into the second pathway and in the second position the second solenoid valve enables passage of air into the second air pathway.

In an aspect the second piston of the first actuator is provided with a front engaging portion to which the engaging portion of the first command cam is destined to be solidly connected, in such a way that the translation of the first and/or the second piston of the first actuator determines a corresponding translation of the first command cam in entry to and exit from the first seating.

In an aspect the first actuator is configured to operate selectively at least among following operating configurations:

a retracted configuration, in which the first and the second solenoid valve close the air passage respectively in the first and the second air pathway and the first and the second piston are both in the first position, the engaging portion of the first cam being retracted in the first seating;

an intermediate configuration, in which the first solenoid valve enables passage of air in the first air pathway, and the second solenoid valve prevents passage of air into the second air pathway, the first piston being in the respective second position and the second piston being in the respective first position, the engaging portion of the first cam being partially advanced in the first seating;

an advanced configuration, in which the second solenoid valve enables passage of air into the second air pathway, the second piston being in the respective second position and the engaging portion of the first cam being completely advanced in the same seating, while the first solenoid valve can enable or prevent passage of air into the first air pathway, the first piston being in the respective first position or in the respective second position.

In an aspect the first actuator comprises at least a first elastic element housed in the first seating and configured and predisposed to generate a thrust on the first piston and/or on the second piston directed, along the longitudinal development, from the head end to the bottom end of the first seating, the first elastic element being able to maintain the first and/or the second piston in the respective first position when the first and/or the second solenoid valve prevent the passage of air into the first and/or second air pathway.

In an aspect the body internally comprises at least a first air discharge organ, or rapid discharge organ, interposed in series along at least the first air pathway and realizing a portion of the air pathway, the air discharge organ being configured and predisposed to enable passage of an air flow from upstream to downstream of the organ along the first air pathway towards the first actuator, and to intercept and discharge towards outside of the organ, i.e. outside the first air pathway, an air flow directed from downstream to upstream of the discharge organ from the actuator along the first air pathway.

In an independent aspect the present invention relates to a method for commanding needles of a needle bed of a knitting machine, the method comprising steps of:

predisposing at least a body having at least an air inlet destined to be connected to a source of compressed air, at least a housing seating for movably housing at least a first actuator in the body, and having at least a first air pathway defined internally of the body and connecting the at least an air inlet with the first seating for moving the actuator by means of the compressed air;

associating and movably mounting to the body at least a first command cam destined to to interact with at least a needle of a needle bed of a knitting machine;

at least partially movably housing a first actuator in the housing seating in the body, which first actuator is destined to move the first command cam in a controlled way;

directly mounting and connecting a first solenoid valve to the body of the device, such that it is directly active at least on the first air pathway, the first solenoid valve being configured and predisposed to selectively enable or prevent the air passage in the first air pathway such as to selectively activate the first actuator;

selectively activating the first actuator, by means of the first solenoid valve, with the aim of commanding the movement of the first command cam and consequently activating or deactivating the interaction of one or more needles with one or more threads for forming the knitting.

In a further independent aspect, the present invention relates to a mobile cam device for commanding needles of a needle bed of a knitting machine, the device comprising:

a body of the device provided with at least a first housing seating having a longitudinal development and configured such as to movably house at least a first actuator in the body;

at least a first command cam movably mounted and associated to the body and destined to interact with at least a needle of a needle bed of a knitting machine, preferably with at least a needle of a cylinder of a circular knitting machine;

at least a first actuator, movably housed at least partially in the first housing seating in the body and destined to move the first command cam in a controlled way.

In an aspect the first actuator comprises a first and a second piston distinct from one another and translatably housed in the first seating, the first and second piston being arranged in series along the longitudinal extension of the first seating and being able to translate independently with respect to one another, the device body being one and one alone, and being made in a single piece.

In an aspect, the first seating is provided with a first bottom end, open on a rear side of the body, and a second head end, opposite the bottom end and open on a front side of the body, destined to be facing toward the needles of the knitting machine, the bottom end enabling insertion in succession of the second and first piston and the head end enabling at least partial insertion of an engaging portion of the first command cam, in such a way that the engaging portion is connectable to the second piston and in that an operating portion of the first cam exits from the first seating, on the front side of the body, in order to cooperate with one or more needles of the needle bed of the knitting machine.

In an aspect the second piston is housed in the first seating downstream of the first piston with to respect to the longitudinal extension of the first seating from the bottom end to the head end, the second piston being selectively translatable in the first seating at least between a respective first position in which it is retracted in the seating and abutting on a head surface of the first piston, and a respective second position in which it is advanced in the first seating with respect to the head surface of the first piston towards the head end.

In an aspect the first seating exhibits a section that does not decrease from the head end to the bottom end. In an aspect the first seating exhibits a tapered section from the bottom end to the head end. In an aspect the first seating does not exhibit undercuts from the head end to the bottom end. In an aspect, the first seating exhibits, in series, from the bottom end to the head end, a first section, a second section and a third section, strictly decreasing and preferably circular. In an aspect the first section exhibits a first diameter, the second section exhibits a second diameter smaller than the first diameter, and the third section exhibits a third diameter smaller than the second diameter. In an aspect the first seating exhibits a first abutment between the first and the second section and a second abutment between the second and the third section.

In an aspect the first piston comprises a rear portion and a front portion that are solidly constrained to one another and develop in series along a longitudinal axis of the first piston, the front portion being downstream of the rear portion when the piston is inserted in the seating, the rear portion receiving a thrust from a compressed air flow supplying the first piston and the front portion axially transmitting the thrust downstream of the piston.

In an aspect the rear portion and front portion of the first piston have a cylindrical conformation, the rear portion having a diameter that is substantially equal to the first diameter and the front portion having a diameter substantially equal to the second diameter, the first piston exhibiting a step between the rear portion and the front portion, the step being substantially complementarily shaped with respect to the first abutment.

In an aspect the second piston comprises a respective rear portion and a respective front portion solid to one another and developing in series along a longitudinal axis of the second piston, the front portion being downstream of the rear portion when the piston is inserted in the seating, the rear portion receiving a respective thrust from a respective compressed air flow supplying the second piston and the front portion axially transmitting the thrust downstream of the piston.

In an aspect the rear and front portions of the second piston have a cylindrical conformation, the rear portion having a diameter that is substantially equal to the second diameter and the front portion having a diameter that is substantially equal to the third diameter, the second piston exhibiting a respective step between the rear portion and the front portion, the step being substantially complementarily shaped to the second abutment.

In an aspect the body is provided with at least an air inlet destined to be connected to a source of compressed air for supplying the first and second piston with compressed air, and to enable movement thereof internally of the seating.

In a further aspect, the present invention relates to a method for realising a mobile cam device for commanding needles of a front of a knitting machine, the method comprising steps of:

predisposing a body of the device provided with at least a first housing seating having a longitudinal extension and configured such as to movably house at least a first actuator in the body, the first seating being provided with a first bottom end, open on a rear side of the body, and a second head end, opposite the bottom end and open on a front end of the body, destined to be facing towards the needles of the knitting machine;

predisposing at least a first command cam destined to interact with at least a needle of a needle bed of a knitting machine, preferably with at least a needle of a cylinder of a circular knitting machine;

predisposing a first actuator comprising a first piston and a second piston and destined to controllingly move the first command cam;

inserting the second piston, from the bottom end of the seating, such that it is housed translatably in the seating;

at least partially inserting in the head end in an engaging portion of the first command cam, and mounting the engaging portion to the second piston, such as to make the first cam solid with the second piston;

inserting the first piston, from the bottom end such that is translatably housed in the seating and is arranged in series with the second piston along the longitudinal development of the first seating;

selectively and independently activating the first and second pistons of the first actuator such as to command the movement of the first command cam.

Each of the above-cited aspects of the invention can be taken alone or in combination with any one of the claims or the other described aspects.

Further characteristics and advantages will more fully emerge, by way of non-limiting example, from the detailed description of some embodiments, among which also a preferred embodiment of a mobile cam device for commanding needles of a needle bed of a knitting machine according to the present invention. This description will be set down in the following with reference to the accompanying drawings, supplied by way of non-limiting example, in which:

FIG. 2 shows a front/above perspective view of the device of FIG. 1;

FIG. 3 is a lateral view of the device of FIG. 1;

Figure 1:
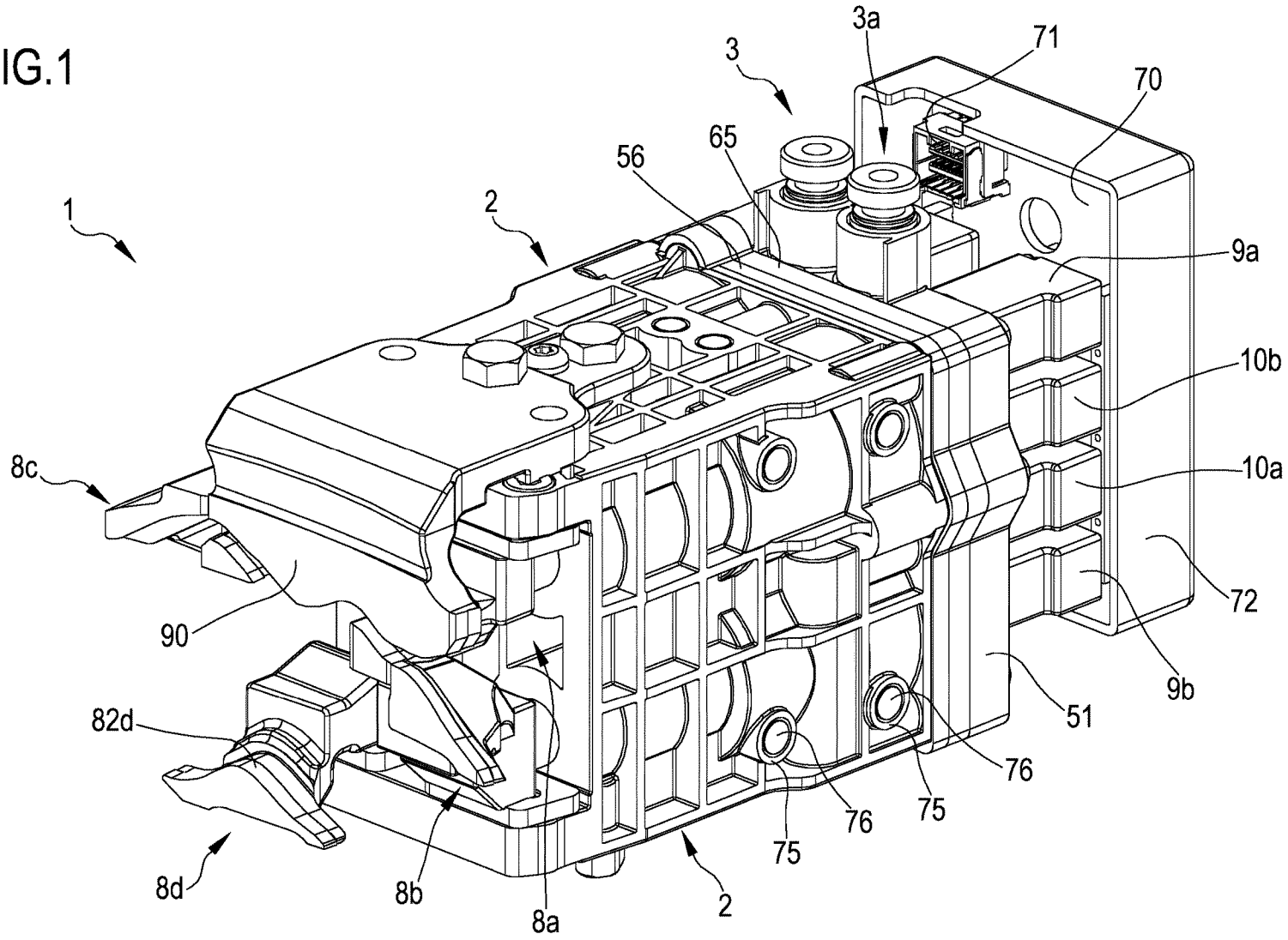
FIG. 1 illustrates a front/above perspective view of a possible embodiment of a mobile cam device according to the present invention.
Figure 6A:
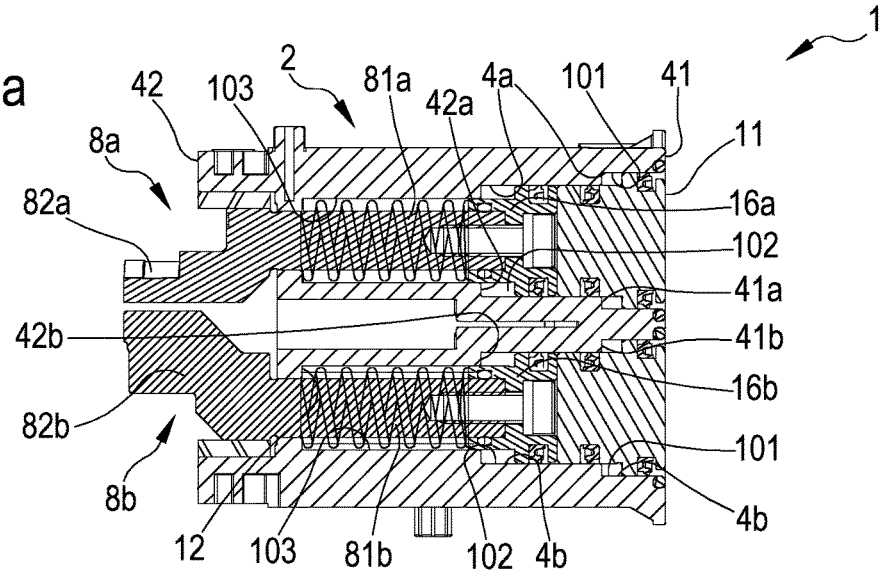
Figure 6B:
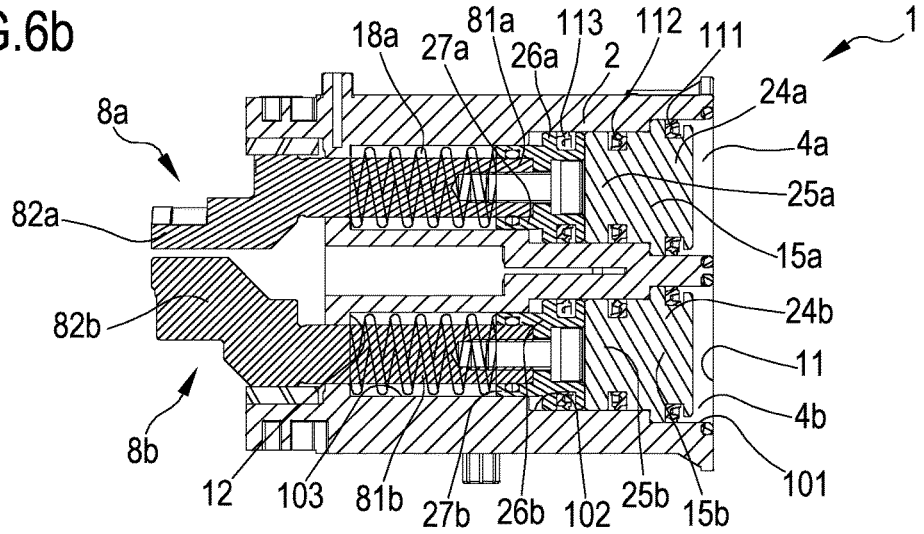
Figure 6C:
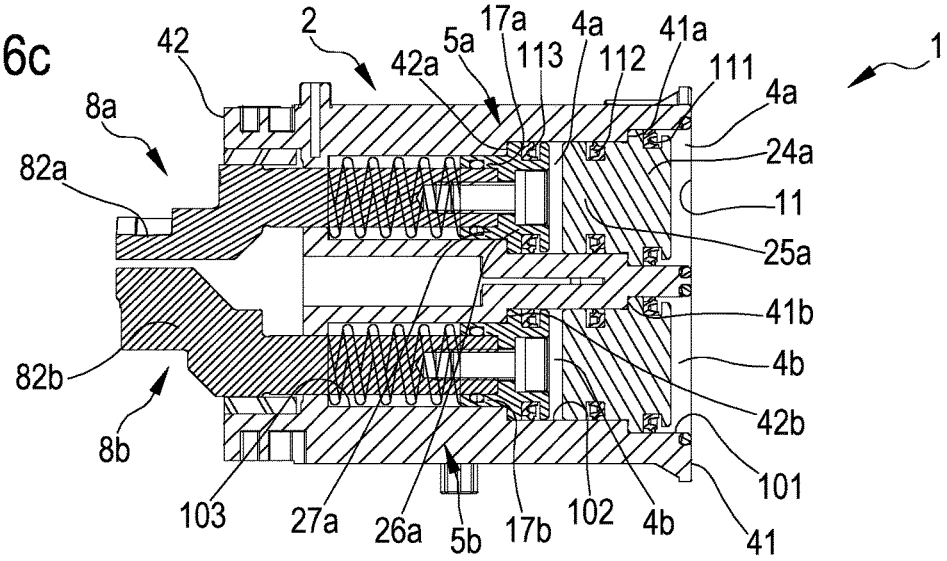
Figure 7B:
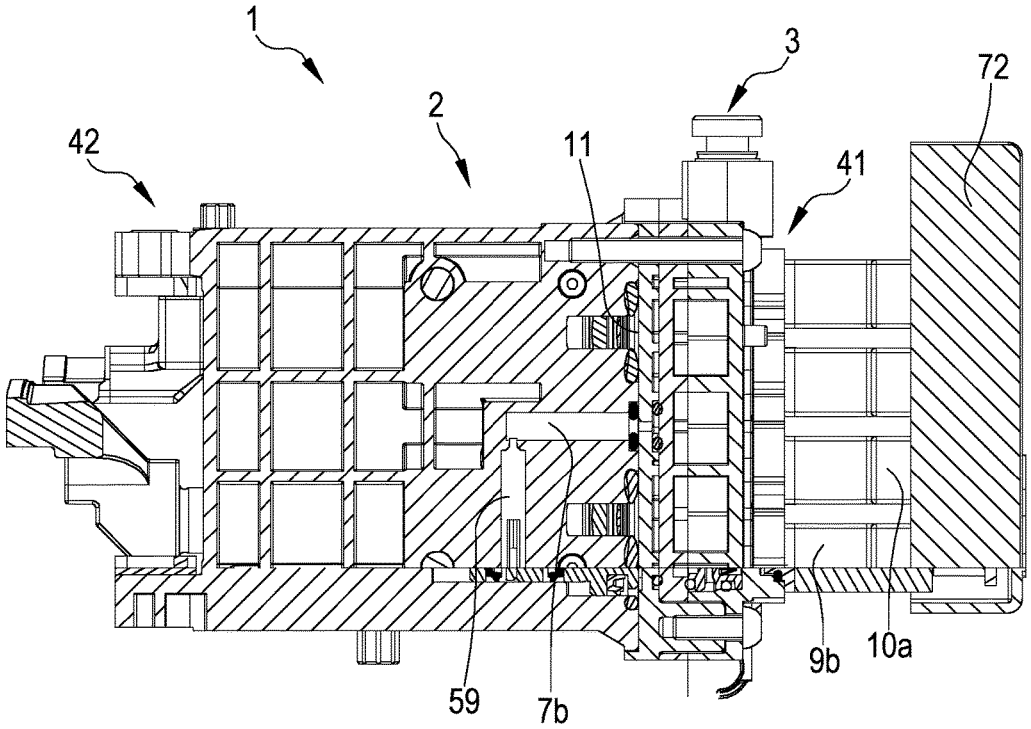
Figure 7C:
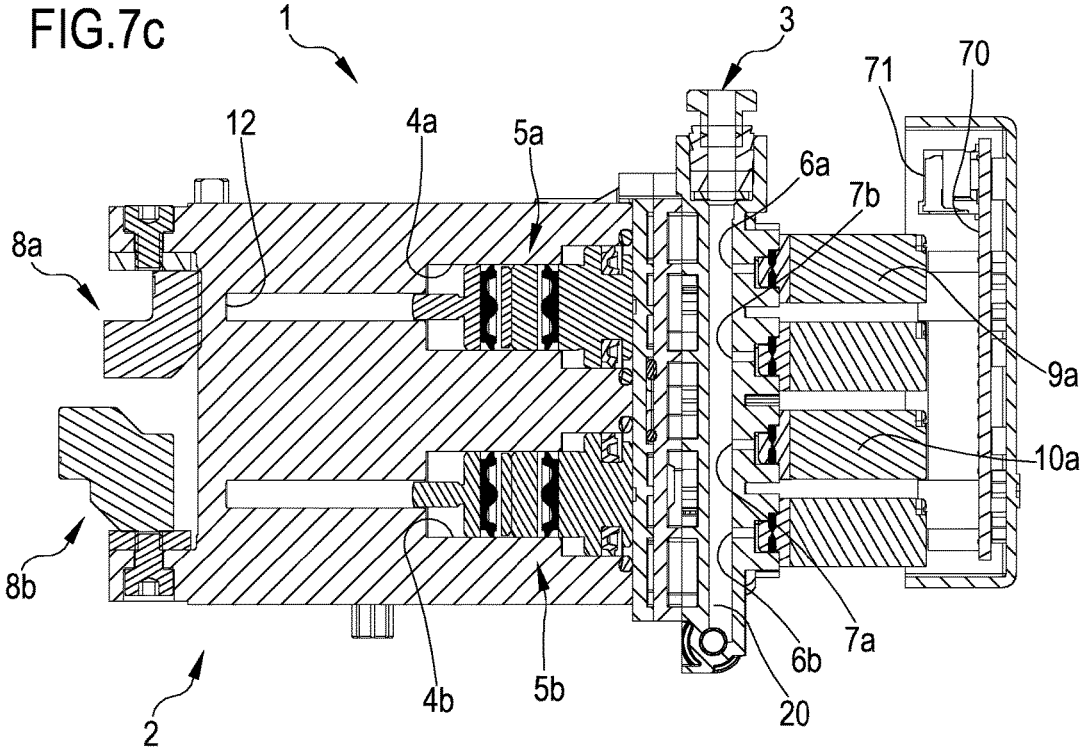
Figure 8:
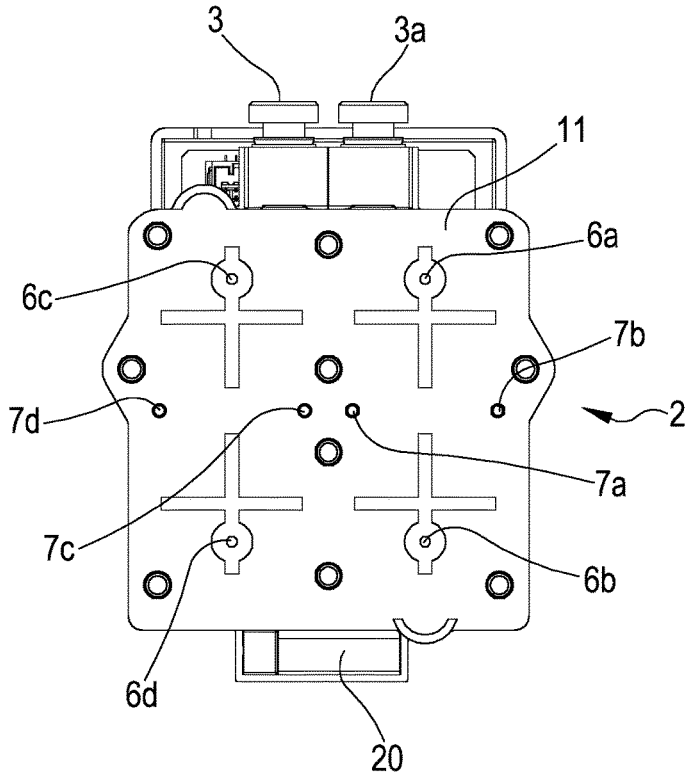
Figure 9:
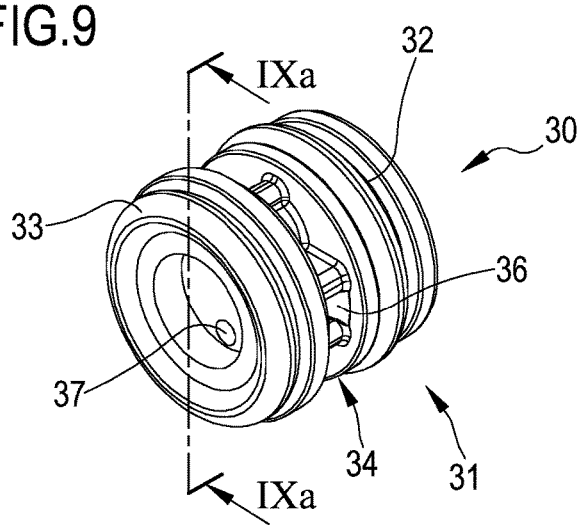
Figure 9A:
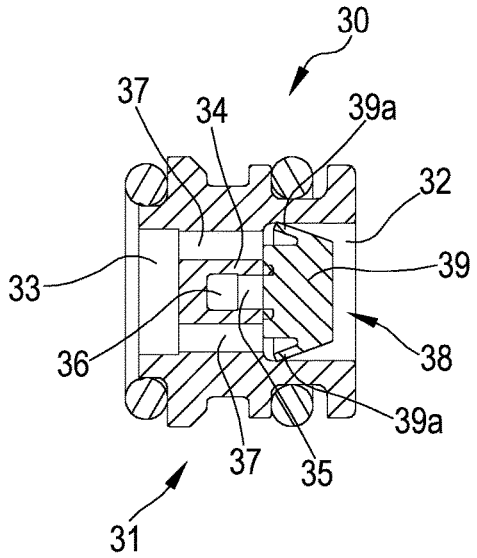
Figure 10:
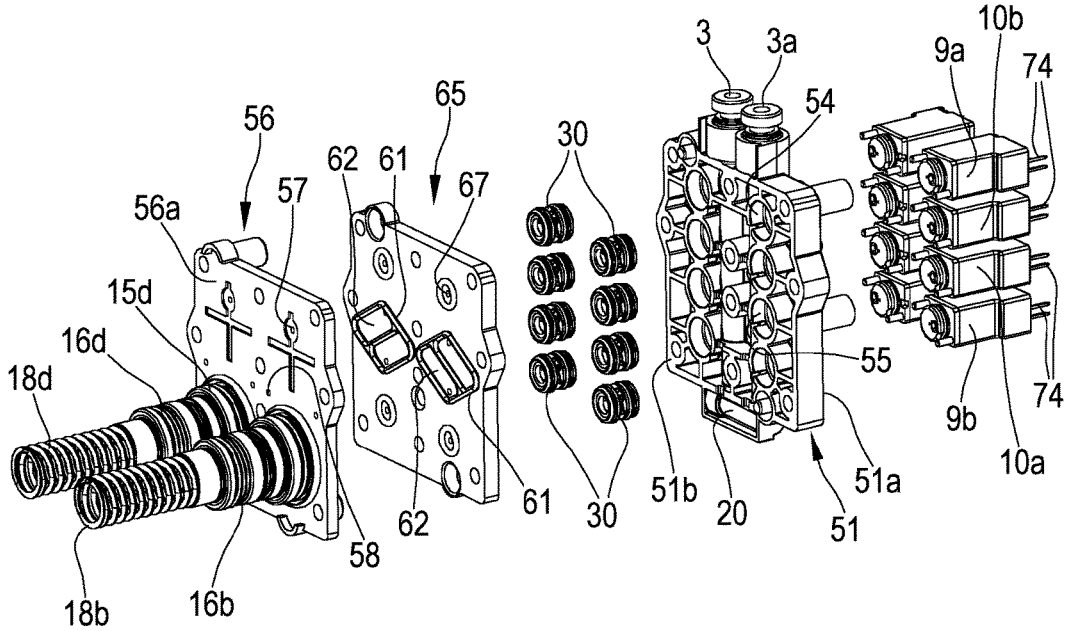
Figure 11:
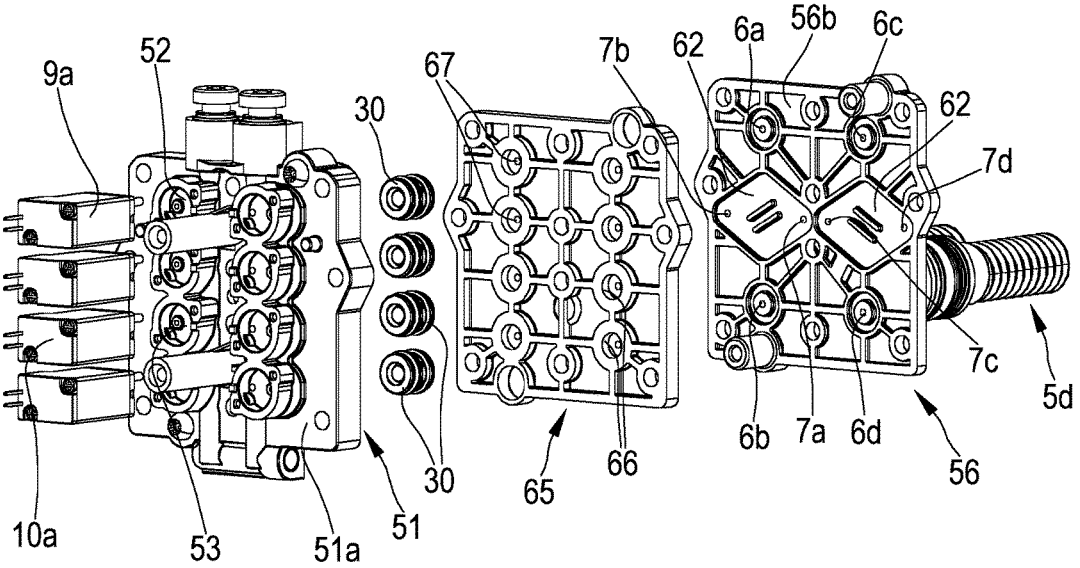

FIGS. 6*a*, 6*b* and 6*c* are longitudinal section views of the device of FIG. 1, with some parts removed, in three different operating configurations, the sections being obtained by sectioning the device along line VIIa-VIIa of FIG. 7;

FIG. 7 illustrates a further rear view of the device of FIG. 1, with some parts removed;

FIG. 7*a* is a further view in longitudinal section of the device of FIG. 1, sectioned along plane VIIa-VIIa;

FIG. 7*b* is a further view in longitudinal section of the device of FIG. 1, sectioned along plane VIIb-VIIb;

FIG. 7*c* is a further view in longitudinal section of the device of FIG. 1, sectioned along plane VIIc-VIIc;

FIG. 8 is a front view of the device of FIG. 1, with some parts removed;

FIG. 9 is a perspective view of a discharge organ that is a part of the device of FIG. 1;

FIG. 9*a* is a view in longitudinal section of the discharge organ of FIG. 9, sectioned along plane IXa-IXa;

FIG. 10 is a further front perspective view, exploded, illustrating some parts of the device of FIG. 1;

FIG. 11 is a further rear perspective view, exploded, illustrating some parts of the device of FIG. 1.

With reference to the figures of the drawings, number 1 denotes in its entirety a mobile cam device for commanding needles of a needle bed of a knitting machine according to the present invention. In general, the same reference number is used for equal or like elements, possibly in variant embodiments thereof.

The device of the present invention is destined to be located in any knitting machine for commanding the needles which interact with the threads for the formation of the knitting stitch; the device in particular is apt for use on circular knitting machines. The knitting machine and the relative needles are not shown in the figures, as they are of known type and conventional type.

The present invention is appropriate for use both in new machines and machines already in existence, in the latter case for replacing command devices of the needle cams of a traditional to type. The functioning of the whole knitting machine (for example the interaction between the command cams and the needles, the cooperation between needles and threads, etc.) is not described in detail, as it is known in the technical sector of the present invention.

The mobile cam device 1 comprises a body 2 having at least an air inlet 3 destined to be connected to a source of compressed air, not illustrated in that it is of known type and constituted, for example, by a compressor or a tank located on-board the knitting machine or in the room where the machine is installed.

The body 2 comprises at least a first housing seating 4*a* for movably housing at least a first actuator 5*a* in the body 2, and at least a first air pathway 6*a* defined internally of the body 2 and connecting the air inlet with the first seating for moving the actuator by means of compressed air.

The device 1 comprises at least a first command cam 8*a* movably mounted and associated to the body 2 and destined to interact with at least a needle of a needle bed of the knitting machine. The device of the present invention is preferably destined to interact with the needles of a cylinder of a circular knitting machine, i.e. the needle bed is a knitting cylinder.

The device comprises at least a first actuator 5*a*, movably housed at least partially in the housing seating and destined to move the first command cam in a controlled way.

The device further comprises at least a first solenoid valve 9*a* mounted and connected directly to the body of the device and active directly on the first air pathway 6*a* to selectively enable or prevent passage of the air from the first air pathway with the aim of selectively actuating the first actuator.

The expression "directly connected" is taken to signify that the solenoid valve is mounted or associated directly to the body of the device, or positioned thereon, such as to be joined to and solidly constrained to the body.

The first seating 4*a* is provided with a first bottom end 11 connected to the first air pathway 6*a* and a second head end 12, opposite the bottom end, in which it is partially inserted (and associated to the first actuator) an engaging portion 81*a* of the first command cam 8*a* such that an operating portion 82*a* of the cam exits from the first seating and from the body so as to cooperate with one or more needles of the knitting machine. In substance, the engaging portion is the part of cam which is connected to the actuator such as to receive the movement therefrom, while the operating portion is the part of cam that exits from the device and is facing, with the device mounted on the machine, towards the needles of a knitting cylinder or a knitting needle bed. The engaging portion, as shown by way of example in the figures, can have a substantially cylindrical shape, for inserting internally of the seating 4*a* of the body 2. The operating portion comprises the actual cam, as shown by way of example in the figures, and consists in an open cam profile, typically variously curvilinear: when the portion of cam cooperates with a needle, in motion with respect thereto (thanks for example to the rotation of the cylinder bearing the needles), it forces movement thereof along a vertical direction, substantially perpendicular to the motion of the cylinder. The operating portion typically comprises a cam profile having an initial point and a final point and developing in such a way as to create a determined law of motion for the needle on passage thereof on the cam. The figures illustrate example cam profiles: on the basis of the type of stitch and/or working, a specific command cam can be selected to associate to the device of the present invention.

For the aims of the present invention, consider that the command cams are destined to act directly on the butts of the needles, such that the needles raise and lower to carry out the knitting operations.

Further, FIGS. 1-4 illustrate, by way of example, a return cam 90 fixed frontally to the body 2; the return cam is not moved but interacts with the needles during the rotation of the cylinder. In this way the return (descent) of the needles can be commanded, being previously activated by a command cam, in a lowered position, according to a determined knitting pattern.

The first actuator 5*a* preferably comprises a first piston 15*a* selectively translatable in the first seating 4*a* at least between a first position in which it is retracted in the seating at the bottom end 11, preferably abuttingly on a surface of the bottom end, and a second position in which it is advanced in the first seating towards the head end 12.

In the first position of the first piston 15*a* the first solenoid valve 9*a* preferably prevents passage of air into the first air pathway 6*a* and in the second position the first solenoid valve enables passage of air into the first air pathway. All the pistons present in the device of the first invention are preferably fluid-dynamic, in particular pneumatic.

The expression "air pathway" is taken to mean a conduit developing internally of the body 2 and carrying a compressed air flow to the actuator. The air pathways shown in the figures, which will be described in detail in the following, constitute only a non-limiting example; embodiments can exist, not illustrated, for the device of the present invention having different air pathways, in which however the basic concept does not change, i.e. the fact that the air pathway dedicatedly conveys the compressed air, when necessary, for activation of the actuator.

The body 2 preferably comprises a second air pathway 7*a*, defined internally of the body and connecting the air inlet 3 or a further air inlet with the first seating 4*a* in a point downstream of the first piston; in a possible variant embodiment (not illustrated) the second air pathway connects the first seating with a further air inlet distinct from the first air inlet 3 and fashioned in the device body. In the embodiment illustrated in FIGS. 1-11, the air inlet is one only for all the air to pathways internal of the body.

The body 2 preferably comprises a second solenoid valve 10*a* mounted and connected directly to the body 2 and directly active on the second air pathway; the second solenoid valve is configured and predisposed to selectively enable or prevent air passage into the second air pathway.

The first actuator 5*a* preferably comprises a second piston 16*a* housed in the seating in series with the first piston 15*a*, i.e. downstream of the first piston with respect to a longitudinal development of the first seating 4*a* from the bottom end 11 to the head end 12. The second piston is selectively translatable into the first seating at least between a respective first position, in which it is retracted in the seating and headed abuttingly on a head surface of the first piston, and a respective second position in which it is advanced in the first seating with respect to the head surface of the first piston towards the head end 12.

In the first position of the second piston, the second solenoid valve 10*a* preferably prevents the passage of air in the second air pathway 7*a* and in the second position the second solenoid valve enables passage of air in the second air pathway.

The second piston 16*a* of the first actuator 5*a* is preferably provided with a front engagement portion 17*a* to which the engaging portion 81*a* of the first command cam 8*a* is destined to be solidly connected, such that the translations of the first 15*a* and the second piston 16*a* of the first actuator 5*a* determine a corresponding translation of the first command cam retractingly and in exit from the first seating 4*a*.

The first actuator 5*a*, when it comprises both the first and the second piston, is preferably configured to selectively operate at least following operating configurations:

- a retracted configuration, in which the first 9*a* and the second solenoid valve 10*a* close the air passage respectively in the first 6*a* and the second air pathway 7*a* and the first 15*a* and the second piston 16*a* are both in the first position, the engaging portion 81*a* of the first cam 8*a* being retracted in the first seating 4*a;*
- an intermediate configuration, in which the first solenoid valve enables passage of air in the first air pathway, and the second solenoid valve prevents passage of air in the second air pathway, the first piston being in the respective second position and the second piston being in the respective first position, the engaging portion of the first cam being partially advanced in the first seating;
- an advanced configuration, in which the first solenoid valve and the second solenoid valve enable passage of air respectively in the first and the second air pathway, and the first and the second piston are both in the respective second position, the engaging position of the first cam being completely advanced in the first seating.

Alternatively, in the advanced configuration the second solenoid valve enables passage of air into the second air pathway, the second piston being in the respective second position, the engaging portion of the first cam being completely advanced in the first seating, while the first solenoid valve can enable or prevent passage of air in the first air pathway, the first piston being in the respective first position or in the respective second position.

In substance, to achieve the advanced configuration, it is necessary for at least the second solenoid valve to enable passage of air into the second air pathway, bringing the second piston forward into the second position thereof; the first piston, which precedes the second piston and is in series therewith, can be both deactivated and activated, i.e. it can be both in the first position thereof (with the first solenoid valve preventing the air passage in the first air pathway) or in the second position thereof (with the first solenoid valve enabling passage of air in the first air pathway).

The three configurations assumed by the first actuator 5*a* (in its entirety) are illustrated in the FIGS. 6*a* (retracted configuration), 6*b* (intermediate configuration) and 6*c* (advanced configuration). In fact it can be observed that:

- in FIG. 6*a* the first and the second piston are both retracted, with the first piston abutting on the bottom of the seating and the second piston abutting on the head of the first piston;
- in FIG. 6*b* the first piston is advanced (therefore detached from the bottom of the seating 4*a*), while the second piston is retracted abuttingly on the head of the first piston;
- in FIG. 6*c* the first and second piston are both advanced, with the first piston advanced (thus detached from the bottom of the seating 4*a*) and the second piston also advanced (therefore detached from the head of the first piston).

The second actuator, described in the following, is also illustrated in the same configurations assumed by the first piston.

The presence of two distinct pistons for each actuator, arranged in series in such a way as to define three different positions (or configurations) for the actuator, does not constitute a mere arbitrary choice but is aimed at a precise purpose, considerably important for numerous knitting machines, in particular circular knitting machines.

In fact, some circular knitting machines comprise, on the cylinder, two different types of needles:

- a first needle group (for example about half the cylinder needles) each provided with a butt having a first radial extension towards the outside of the cylinder; this type of butt is known in the sector as "low" or "short";
- a second needle group (typically the remaining needles in the cylinder) each provided with a butt having a second radial extension, towards the outside of the cylinder, larger than the first extension; this type of butt is known in the sector as "high" or "long".

When the actuator is in the retracted configuration the corresponding command cam is in the "zero" position, in which it does not interact with any of the needles, leaving them "deactivated" or "deinserted" (i.e. not cooperating with the thread). When the actuator is brought into the intermediate configuration, the cam advances (towards the rotating cylinder) up to the intermediate position, in which it does not interact with the short needles (as the butt thereof is low, hardly emerging radially of the cylinder), while it interacts with the long-butt needles, which "rise" onto the cam and are "inserted", i.e. raised into the work position.

Once the high-butt needles are raised, the actuator can move into the advanced configuration, i.e. it pushes forward (towards the cylinder) the respective command cam, unobstructed by the high-butt needles as they are already raised by the cam into the intermediate position. In the advanced configuration the command cam reaches the cylinder by abutting thereon (in the sector it is sometimes said that the cam "enters" onto the cylinder) and therefore can interact with the low-butt needles, raising them too and bringing them into a work position, as previously done for the high-butt needles.

The subdivision of the needles into two groups is therefore necessary for enabling the inserting of the command cams on the cylinder; the presence of two pistons for each actuator enables activating the two needle groups in sequence, repeating the operation at each cylinder rotation.

In addition, according to needs, the two distinct positions of the cam (intermediate and advanced) can enable activation of two different needle groups selectively: by bringing the cams into the intermediate or advanced position in determined fractions of rotations of the cylinder it is possible to interact only with butts of certain needles (on the basis of the arrangement in the cylinder of the low-butt needles and the high-butt needles).

The actuator comprising two distinct pistons actuable independently of the solenoid valve thus enables obtaining three different advancements for the first command cam; in this way it is further possible to manage, if necessary, several positions for the needle commanded by the command cam.

In a possible simplified embodiment (not shown) of the device of the present invention, the actuator comprises a sole piston: in this case the configurations obtainable are two only, respectively retracted and advanced, which respectively command the de-insertion and insertion of the needle or needles cooperating with the device.

The first seating preferably has a cylindrical conformation; the first and second piston also have a preferably cylindrical conformation such as to be complementarily shaped to the seating. As shown in FIGS. 7*a*-7*c*, the actuator preferably comprises one or more seal elements (for example rubber seals or the like) configured such as to enable an air-sealed sliding of the first and second piston internally of the seating and to prevent air leakage between the first and the second air pathway.

The first seating 4*a* preferably comprises a first abutting section 41*a* configured such as to halt the advancing of the first piston from the bottom end of the seating when the first piston passes from the first to the second position. The first abutting section defines the second position of the first piston and preferably consists of a narrowing of the section (or abutment) of the first seating.

The first seating 4*a* preferably comprises a second abutting section 42*a* positioned downstream of the first abutting section 41*a* with respect to the longitudinal extension of the first seating 4*a* from the bottom end to the top end; the second abutting section is configured to halt the advancing of the second piston from the head surface of the first piston when the second piston passes from the respective first to the respective second position. The second abutting section defines the second position of the second piston and preferably consists of a further narrowing of section (or abutment) of the first seating.

As shown by way of example in FIGS. 5, 6*a*, 6*b* and 6*c*, the first actuator 5*a* preferably comprises at least a first elastic element 18*a* housed in the first seating 4*a* and configured such as to generate a thrust on the first piston and the second piston directed, along the longitudinal extension, from the head end to the bottom end of the first seating. The first elastic element is able to maintain the first and/or the second piston in the respective first positions when the first and/or the second solenoid valve prevent passage of air in the first and/or the second air pathway.

The first elastic element 18*a* is preferably configured such as:

- to determine the return of the first and second piston into the respective first position when the first actuator is in the retracted configuration;
- to determine the return of the second piston into the respective first position when the first actuator is in the intermediate configuration, enabling passage of the first piston into the respective second position;
- to enable passage of the first and the second piston into the second position when the first actuator is in the advanced configuration.

The first elastic element 18*a* is preferably in the first seating 4*a* and is interposed between the head end of the seating and a head surface of the second piston. The first elastic element 18*a* is preferably a helical spring.

In substance, the elastic element acts on the head of the second piston and pushes on both the pistons towards the bottom of the seating; in this way the elastic element enables returning the first and second piston into the respective retracted position, when the respective solenoid valve closes the respective air pathway. The elastic element has an elastic constant such as to enable pushing the pistons onto the bottom of the seating when air pressure is not present in the air pathways and to enable exit therefrom when compressed air is present. This means that the elastic element is not able to halt the exiting of a piston when it is supplied with compressed air (by means of opening the air conduit by the respective solenoid valve), while it forces return when upstream of the piston there is no compressed air. When the first piston is supplied with compressed air while the second piston is not supplied, the elastic element pushes the second piston in abutment on the first, which however can move into the second position thereof (also pushing the second piston forwards); when on the other hand it is the second piston that is supplied with compressed air while the first is not supplied, the elastic element is compressed under the pushing effect operated by the second piston, bringing the actuator into the advanced configuration.

As shown in FIGS. 5, 6*a*-6*c*, the elastic element preferably has a first end abutted on an abutment surface of the head end of the seating (realised as an abutment, or a narrowing of section, internally of the seating), preferably downstream of the second abutting section. The elastic element is preferably wound about the portion of cam inserted in the seating (or the engaging portion of the cam).

As shown by way of example in FIGS. 9 and 9*a*, the body 2 preferably comprises internally thereof at least a first air discharge organ 30, or rapid discharge, interposed in series along at least the first air pathway (i.e. intercepting the first air pathway) and itself realizing a portion of the air pathway.

The air discharge organ 30 enables passage of an air flow from upstream to downstream of the organ along the first air pathway 6*a* towards the first actuator 5*a* and intercepts, by discharging it towards the outside of the organ (i.e. out of the first air pathway), an air flow directed from downstream to upstream of the discharge organ from the first actuator along the first air pathway.

In substance, the rapid discharge organ 30 behaves like a check valve with respect to a flow which crosses it positively, i.e. along an air supply direction directed to the first actuator, preventing return of air from the actuator; in addition, it behaves as a discharge valve with respect to a flow which crosses it negatively, i.e. in an opposite direction to the air supply; this discharge valve conveys the return air (from downstream to upstream of the organ) externally of the organ, evacuating the air out of the first air pathway.

The discharge organ 30 preferably comprises a body 31, preferably in a single piece, provided with a rear portion 32, a front portion 33 and an intermediate portion 34, interposed between and connecting the front and rear portions. The rear portion 32 is connected to the side of the air pathway 6*a* communicating with the air inlet 3 and the front portion 33 is connected to the side of the air pathway communicating with the actuator.

The rear 32, intermediate 24 and front 33 portions are preferably aligned axially with one another, as shown by way of example in the figures.

The body 31 of the discharge organ 30 comprises a central hole 35, connecting the rear portion with an opening 36 fashioned in the intermediate portion 34 and communicating with outside the body, and at least a lateral hole 37, crossing the intermediate portion and placing the rear portion 32 in communication with the front portion 33.

The discharge organ 30 comprises an elastic membrane 38 housed in the rear portion 32 and configured such as to selectively and reversibly operate automatically on the basis of the air flow direction, between an open configuration, in which the membrane enables passage of an air flow from the rear portion to the front portion by means of the at least a lateral hole 37, and a discharge configuration, in which the membrane prevents the return of air upstream of the rear portion, and wherein a flow of air coming from the front portion 33 and crossing the at least a lateral hole is conveyed into the rear portion 32 and evacuated, via the central hole 35, to outside the body 31 of the discharge organ. The lateral holes 37 are preferably two (as shown in FIGS. 9, 9*a*), for example arranged in diametrically opposite positions with respect to the central hole.

The elastic membrane 38 preferably comprises a central body 39, preferably cylindrical, and an annular portion 39*a* extending radially from the central body and foldably constrained to the central part. The annular portion 39*a* is configured to fold towards the front portion 33 of the body 31 of the discharge organ 30 by effect of the push exerted by an air flow directed from upstream to downstream of the organ, enabling the flow to cross the lateral hole 37 (in the case in the figure the two lateral holes) towards the front portion 33 and thus towards the actuator 5*a* and closing the central hole 35 by means of the central body 39. The annular portion 39*a* is further configured to obstruct the rear portion 32 of the body of the discharge organ by effect of the push exerted by an air flow facing from downstream to upstream of the organ, and to axially distance the central body 39 from the central hole 35, freeing an air passage, in the rear portion, from the lateral hole (in the figure two lateral holes 37) to the central hole 35, and from the central hole 35 towards the opening 36 of the intermediate portion communicating with the outside of the discharge organ.

The annular portion 39*a* constitutes a lip seal facing towards the pathway direction of the discharge organ from the rear portion to the front portion. The central body and the annular portion of the elastic membrane are preferably made in a single piece, preferably of rubber or a plastic material. The discharge organ has the function of discharging the return air out of the respective air pathway from the actuator towards the solenoid valve (for example the air directed from downstream to upstream of the air pathway by effect of the thrust of the first and/or second piston when they return into the respective first position); this enables expelling impurities from the air pathway, such as particles or dirt, lubricating oil, air condensation, etc., preventing it from reaching the solenoid valve at the start of the air pathway. This problem in fact afflicts known devices, in which the lack of the discharge organ does not enable the air pathway to be kept clean. The above-mentioned impurities (in particular the oil and the condensation) are extremely damaging in particular for the solenoid valve, and typically are the cause of faults, malfunctioning and a drop in performance.

The components of the devices described up to now are those relating to the first command cam (a seating, an actuator with two pistons, two air pathways and two solenoid valves): a device configured in this way is defined in the sector with the term "single cam", as indeed it commands a single needle cam.

In a possible embodiment, the device of the present invention further comprises a second actuator 5*b*, movably housed at least partially in a second housing seating 4*b* (preferably identical or equivalent to the first housing seating 4*a*) fashioned in the body 2, the second actuator 5*b* being able to move, in a controlled way, a second command cam 8*b* which interacts with at least a needle of a needle bed of a knitting machine. In this configuration the device is known as "dual cam", as it enables independent command of two distinct needle cams. A device of this type further comprises a respective first air pathway 6*b* defined internally of the body 2 and connecting the air inlet 3 with the second actuator 5*b* such as to move it by compressed air. The device further comprises a respective first solenoid valve 9*b* for the second actuator 5*b* mounted and connected directly to the body 2 and directly active on the respective first air pathway 6*b* of the second actuator 5*b*; the respective first solenoid valve 9*b* of the second actuator 5*b* selectively enables or prevents the air passage in the respective first air pathway 6*b* such as to selectively activate the second actuator 5*b*.

As can be observed in FIGS. 5, 6*a*-6*c*, 7*a*-7*c*, the second actuator 5*b* comprises a respective first piston 15*b* of the second actuator identical to the first piston of the first actuator. The body 2 further comprises a respective second air pathway 7*b* of the second actuator, defined internally of the body and connecting the air inlet with the second seating in a point downstream of the respective first piston of the second actuator, and a respective second solenoid valve 10*b* of the second actuator connected directly to the body and directly active on the respective second air pathway 7*b* of the second actuator. The second actuator 5*b* preferably comprises a respective second piston 16*b* identical to the second piston of the first actuator.

The second piston 16*b* of the second actuator 5*b* is preferably provided with a respective front engaging portion 17*b* to which the engaging portion 81*b* of the second command cam 8*b* is solidly connected.

The second actuator 5*b* is preferably configured to operate selectively at least between a respective retracted configuration, a respective intermediate configuration, and a respective advanced configuration alike to the retracted, intermediate and advanced configurations described for the first actuator.

The second seating 4*b* preferably comprises a respective first abutting section 41*b* configured such as to halt the advancing of the first piston from the bottom end of the seating when the first piston passes from the first to the second position. The second seating 4*b* preferably comprises a respective second abutting section 42*b*, positioned downstream of the first abutting section 41*b* with respect to the longitudinal extension of the second seating 4*b* from the bottom end to the head end; the second abutting section 42*b* is configured such as to halt the advancing of the second piston when it passes from the respective first to the respective second position.

The second actuator 5*b* preferably comprises a second elastic element 18*b* identical to the elastic element of the first actuator.

The device 1 of the present invention can advantageously also comprise a third actuator 5*c*, preferably identical or equivalent to the first and/or the second actuator, so as to move in a controlled way a third needle command cam 8*c*; in this case the device is known as a triple-cam device.

The device 1 of the present invention can advantageously comprise also a fourth actuator 5*d*, preferably identical or equivalent to the first and/or the second and/or the third actuator, such as to move in a controlled way a fourth needle command cam 8*d*; in this case the device is known as a quadruple-cam device.

The device 1 illustrated in FIGS. 1-11 relates, without constituting any limitation for the invention, to the complete configuration, i.e. the one comprising four distinct commands for four distinct cams; the device of the present invention can, when needed, integrate a greater number of actuators and/or solenoid valves (on the basis of the number of cams which are to be commanded and/or the required movements).

In FIGS. 1-11, the four actuators 5*a*, 5*b*, 5*c* and 5*d* are substantially identical to one another: each of them comprises a respective seating (4*a*, 4*b*, 4*c*, 4*d*), a respective first pathway (6*a*, 6*b*, 6*c*, 6*d*), a respective first solenoid valve (9*a*, 9*b*, 9*c*, 9*d*), a respective first piston (15*a*, 15*b*, 15*c*, 15*d*), a respective second air pathway (7*a*, 7*b*, 7*c*, 7*d*), a respective second solenoid valve (10*a*, 10*b*, 10*c*, 10*d*), a respective second piston (16*a*, 16*b*, 16*c*, 16*d*), a respective elastic element (18*a*, 18*b*, 18*c*, 18*d*). Also, each single air pathway comprises a respective rapid discharge organ (therefore preferably two discharge organs for each actuator).

The four command cams 8*a*, 8*b*, 8*c* and 8*d* are each provided with a respective engaging portion and a respective operating portion; the cams are functionally equivalent to one another, and are distinguished by the axial extension of the operating portion and for the dimensions and conformation of the cam profile.

The elements dedicated to the second, third and fourth actuator are preferably equivalent to the corresponding elements dedicated to the first actuator.

The first and second solenoid valves (as shown in FIGS. 1-11) of each actuator (preferably all the actuators) are preferably identical to one another. Each solenoid valve is preferably singly and removably mounted to the device body. In FIGS. 1-11 eight distinct solenoid valves are visible (two for each of the four actuators, provided each with two pistons).

Each solenoid valve is preferably mounted to the body 2 such as to be separate from the adjacent solenoid valves from an empty space having a dimension of greater than or equal to an empty space having a dimension greater than or equal to 0.5 mm, preferably 1 mm, still more preferably 2 mm. In this way the overheating of the solenoid valves can be prevented, which typically leads to faults and malfunctioning of the solenoid valves.

Figure 4:
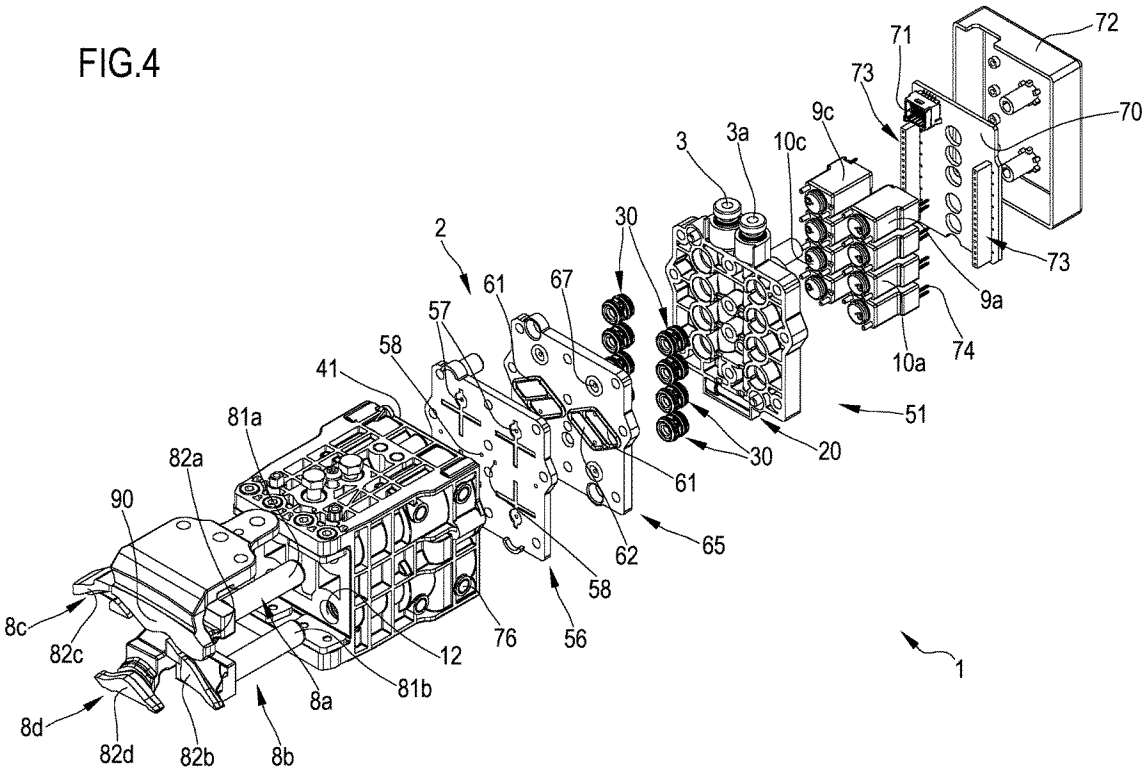
FIG. 4 is an exploded perspective view of the device of FIG. 1.
Figure 5:
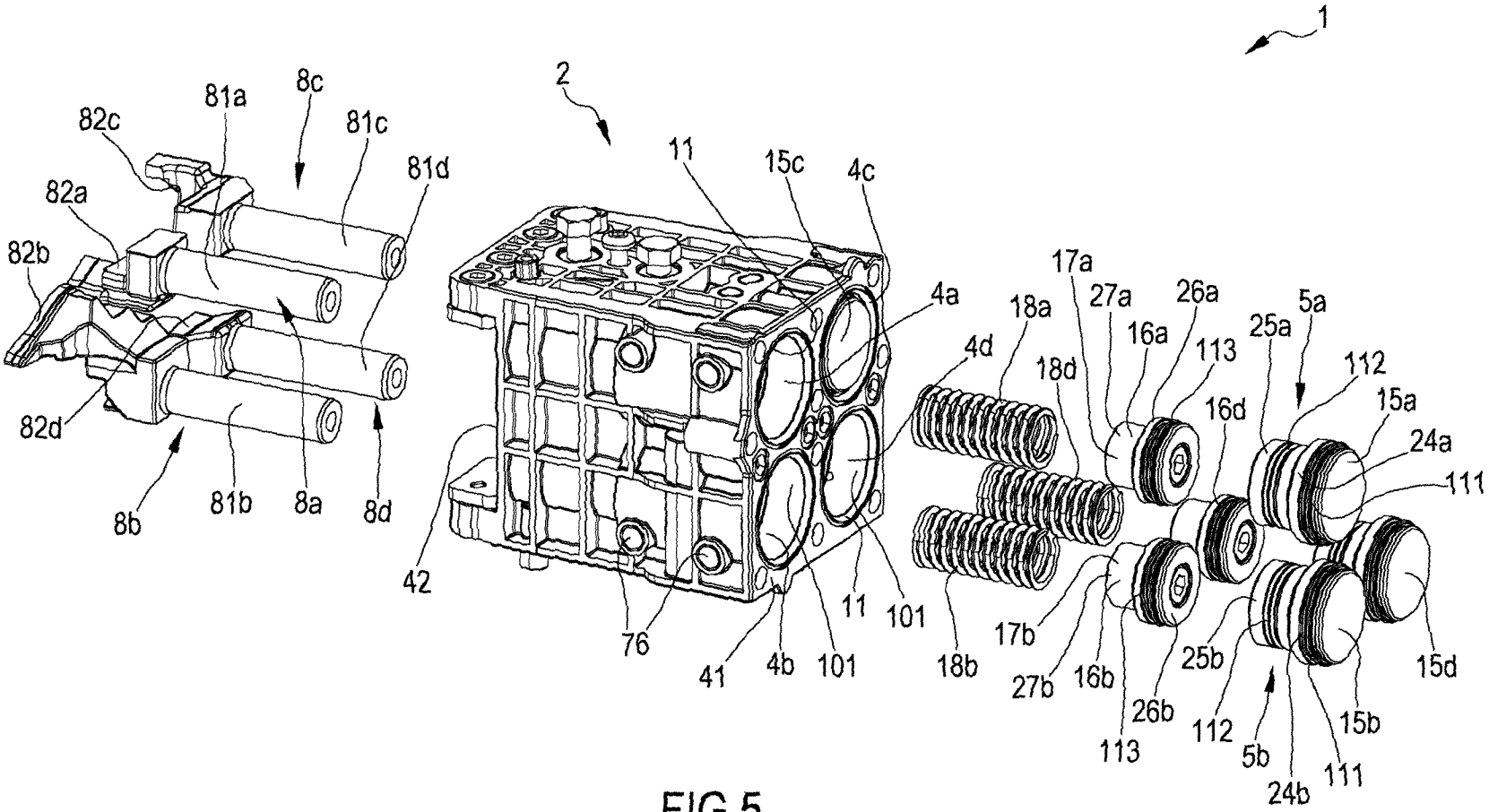
FIG. 5 is a further exploded perspective view of the device of FIG. 1, with some parts removed.

As illustrated in FIGS. 1-11, the body 2 of the device 1 comprises a rear side 41, on which the solenoid valves of the actuators are positioned, and a front side 42, opposite the rear side 41, destined to be facing toward the needles of the knitting machine and on which open the respective head ends 12 of the first seating, the second seating, the third seating and the fourth seating, from which emerge respectively the first, second, third and fourth command cams. With reference in particular to FIGS. 4, 10 and 11, a more fully detailed description is now made of the structure of the body 2 of the device, according to a possible embodiment.

The body 2 preferably comprises an air supply conduit 20 extending from the air inlet 3 and terminating with an air outlet 3*a* destined to be connected to a respective air inlet of a further device 1 for commanding needles or another user device using compressed air.

In other words, the compressed air flow coming from the compressed air source can reach the device of the present invention by means of the air inlet, supply the internal air pathways of the body and proceed beyond the body exiting from the air outlet 3*a*; in this way, by connecting, by means of an external air conduit (for example a tube or the like), the air outlet of the body (2) to the inlet of a further device, it is possible to supply the further device directly in series with the first, without any need to connect the further device singly to the pressure source.

The connection "in series" towards a further device (in particular towards an identical device which is a part of the knitting machine) can proceed for any number of devices, preferably all the devices present in the machine, creating a "loop" structure which starts from the source and pneumatically supplies in series the various devices, "entering and exiting" each towards the next. This is advantageous as in a knitting machine there are typically present numerous command devices and the presence of the inlet 3 and the outlet 3*a* in the body 2 does away with the need to connect each device singly to the compressor (or tank or other supply of compressed air), although it is sufficient to supply the first device 1 and pass from this to the next, and so on.

Internally of the body 2, all the air pathways branch (in parallel) preferably branch from the supply conduit 20, such that they are all suppliable with compressed air; in other words, the air pathways of the body are preferably all connected, at different points, to the supply conduit 20, and through this to the air supply inlet 3. Preferably, as shown in FIGS. 1-5, 10-11, the body 2 of the device comprises a single air inlet 3 and/or a single air outlet 3*a* and/or a single air supply conduit 20. In the figures, the supply conduit is U-shaped and the air inlet 3 and the air outlet 3*a* and/or a single air supply conduit 20. In the figures, the supply conduit is U-shaped and the air inlet 3 and outlet 3*a* are flanked to one another. Some parts of the air pathways internal of the body 2 can be shared (for example parts of the single supply conduit 20 between the inlet and the outlet).

The body 2 of the device preferably comprises an external plate 51, removably mounted on the rear side 41 of the body and provided with the air inlet 3 and the air outlet 3*a*. The external plate preferably internally defines the supply conduit 20, between an external side 51*a* and an internal side 51*b* thereof.

The external plate 51 preferably comprises, on the external side 51*a*, at least a first mounting seating 52 configured and predisposed to house, preferably removably, the first solenoid valve 9*a* of the first actuator 5*a*, and communicating with the supply conduit 20. The external plate 51 preferably comprises, on the internal side 51*b* thereof, at least a first opening 54, communicating with the solenoid valve, from which the first air pathway 6*a* for the first actuator 5*a* branches.

Each solenoid valve preferably internally defines a portion of the respective air pathway in which it is inserted. In greater detail, each solenoid valve is connected to the compressed air supply conduit and has a respective compressed air outlet, selectively openable and closable. When the solenoid valve is commanded not to supply the respective piston, it closes the respective air outlet and the respective air pathway does not carry compressed air to the piston; on the contrary, when the solenoid valve is commanded to supply the relative piston, it opens the respective air outlet and thus the respective air pathway takes compressed air to the piston, determining movement thereof.

The above first opening 43 of the external plate is preferably arranged on the internal side of the first plate such as to correspond with the air outlet of the first solenoid valve mounted on the mounting seating on the external side of the first plate; in this way, when the solenoid valve opens and closes its air outlet, it respectively enables and prevents the passage of the compressed air from the air inlet 3 into the first air pathway. The external plate 51 preferably comprises, on the external side 51*a* thereof, a second housing seating 53 configured and predisposed to house, preferably removably, the second solenoid valve 10*a* of the first actuator 5*a*, and communicating with the supply conduit 20. The external plate 51 preferably comprises, on the internal side 51*b* thereof, a second opening 55, communicating with the respective solenoid valve, from which the second air pathway 7*a* for the first actuator 5*a* branches. As described for the first opening 54, the second opening 55 is arranged on the internal side of the first plate such as to correspond with the respective air outlet of the second solenoid valve mounted on the mounting seating on the external side of the first plate; in this way, when the solenoid valve opens and closes the air outlet thereof, it respectively enables and prevents the compressed air passage from the air inlet into the second air pathway.

As described by way of example in FIGS. 4, 10 and 11, the external plate 51 preferably comprises, on the external side thereof, a plurality of mounting seatings, each configured such as to house, preferably removably, a respective solenoid valve of one of the first, second third and fourth actuator. In particular, the plate comprises a pair of mounting seatings 52, 53 for each pair of solenoid valves of each actuator (in the embodiment of FIGS. 1-11 four command cams are present, each actuated by means of two solenoid valves, for a total of eight mounting seatings on the external plate).

The external plate 51 preferably comprises, on the internal side thereof, a plurality of openings in the supply conduit from which branch respective air pathways for one of the first, second, third or fourth actuator, in which each opening is arranged on the internal side of the first plate at the respective solenoid valve positioned externally of the external plate.

In particular, the plate comprises a pair of openings 54, 55 for each pair of air pathways of each actuator (in the embodiment of FIGS. 1-11 four command cams are present, each actuated by means of two air pathways, for a total of eight openings in the external plate).

The mounting seatings 52, 53 of the external plate are preferably identical to one another and configured such as to distance the adjacent solenoid valves mounted thereon of an empty space having a larger dimension than or equal to 0.5 mm and/or 1 mm and/or 2 mm.

The body 2 of the device preferably further comprises an internal plate 56, removably mounted to on the rear side 41 of the body in such a way as to be interposed between the body 2 and the external plate 51, the internal plate being provided with at least a first through-hole 57 passing between an external side 56*a* and an internal side 56*b* of the internal plate and configured such as to set in communication the first opening 54 on the internal side of the external plate with the bottom end 11 of the first seating 4*a*, the first opening 54 and the first through-hole 57 realising the first air passage 6*a* taking compressed air to the first piston 15*a* of the first actuator 5*a*.

The first through-hole 57 is preferably positioned in the internal plate 56 such as to be aligned with the first opening on the internal side of the external plate, and the first air pathway substantially reaches straight to the bottom end of the first seating.

The internal plate 56 is preferably provided with a second through-hole 58 passing between the external side and the internal side thereof and configured such as to plate the second opening 55 on the internal side of the external plate in communication with an internal conduit 59 of the body 2 beginning on the rear side 41 of the body, on which the bottom end 11 of the first seating is open, extending into the body 2 laterally of the first seating 4*a* and opening in the first seating at the point downstream of the first piston.

The second through-hole 58 is preferably positioned in the internal plate such as to be dealigned, at least laterally and inferiorly or laterally and superiorly, with respect to the second opening on the internal side of the external plate, and the body comprises at least a seal 61 interposed between the external plate and the internal plate such as to realize a chamber 62 placing the second opening in communication with the second through-hole.

The second opening 55, the chamber 62 realised by the seal 61, the second through-hole 58 and the internal conduit 59 preferably realise the second air pathway carrying compressed air to the second piston of the first actuator.

The configuration of the two air pathways enables carrying compressed air singly to the first and the second piston of an actuator: in detail, the first air pathway is linear and opens on the bottom of the seating (such as to move the first piston), while the second air pathway is deviated internally of the body in order to enter the body laterally to the seating and to enter it at a point thereof downstream of the first piston such as to supply the second piston (placed in series with the first) with compressed air.

The configuration of the holes in the plates enables overcoming the geometric limits set in the body 3 by the presence of a single seating with two distinct pistons (which require being singly actuated) and by the presence, additionally, of a plurality of seatings (for a plurality of command cams).

The internal plate 56 is preferably provided with a further first through-hole and with a further second through-hole, destined to set in communication respectively a further first opening and a further second opening of the external plate and to realise the respective first air pathway and second air pathway such as to carry compressed air to the respective first and second piston of the second actuator.

The internal plate is preferably provided with one or more further pairs of first and second through-holes destined to place in communication one or more further first and second openings of the external plate in order to realise one or more further first and second air pathways to bring compressed air to further first and second pistons of further actuators, for example the third actuator and/or the fourth actuator.

As shown in particular in FIG. 11, the external plate 51 preferably comprises, on an internal side thereof, one or more housing seatings, each configured and predisposed to house, preferably removably, a respective discharge organ 30, each housing seating being positioned in such a way as to align with a respective opening (54 or 55) on the internal side of the external plate and with a respective mounting seating (respectively 52 or 53) of a solenoid valve on the external side of the external plate.

In a possible embodiment (as shown in FIGS. 1-11) the external plate 51 comprises an intermediate plate 65, associated to the internal side of the external plate in such a way as to be interposed between the external plate and the internal plate, the intermediate plate exhibiting counter-seatings 66 for housing a discharge organ 30 each cooperating with a respective housing seating of the housing seatings in order to sealedly house a respective discharge organ and exhibiting a through-hole 67 at or aligned to a respective air opening of the external plate.

The intermediate plate 65 is preferably distinct from the external plate and is removably mounted thereto; alternatively, the intermediate plate can be realised in a single piece with the external plate.

In substance, the two plates (external and internal) enable defining the air pathways from the solenoid valves (flanked to one another) to the pistons (aligned in series, two for each actuator). The intermediate plate can be omitted in a case in which the discharge organs are not present along the air pathways; should it be present, the intermediate plate aids in defining the air pathways.

In FIGS. 1-11, which show a device 1 of the quadruple cam type, two seals 61 are present (in the sector also known as pyramid seals), each of which defines two of the chambers 62 between the external plate and the internal plate. A first seal defines two chambers, respectively the chamber of the second air pathway of the first actuator and the chamber of the second air pathway of the second actuator; the second seal defines two chambers for the second air pathways of the third and fourth actuator. Thanks to the chambers realized between the external plate (or the intermediate plate which is a part thereof) and the internal plate, the air supply can be moved (i.e. each second air pathway deviated) up to the second piston of each actuator (the second piston being in series with the first piston, and therefore not axially reachable due to the presence of the first piston). The external and/or internal and/or intermediate plates are mounted to the body by special fastening screws. The body 2 is preferably made of a composite material, for example a mixture of plastic materials (for example nylon) and/or glass fibre and/or carbon fibre.

The device 1 preferably comprises electronic control means configured and predisposed to manage the functioning of the device, in particular in order to command the solenoid valves of the device and to interface the device with a central unit of the knitting machine (not illustrated).

The electronic control means can receive the instructions relating to the management of the device by the central unit of the knitting machine or can themselves process the control instructions for the device.

The electronic control means preferably comprise an electronic board 70 associated (preferably directly mounted) to the body 2.

The electronic board preferably comprises an assembly of connectors 73 (for example a series of seatings or sockets) configured such as to electrically and electronically connect the solenoid valves to the electronic board; each solenoid valve comprises one or more respective pins 74 which insert in one or more of the connectors 73. The electronic board preferably comprises a connecting port 71 (for example a network port of a fieldbus port) configured to enable the connection of the device 1 to the central unit of the knitting machine. The device can preferably comprise a casing 72 housing the electronic board.

The body 2 can comprise (as shown by way of example in FIGS. 1-11) a series of holes 75 (or vents 75), located preferably on a lateral surface of the body, connecting the inside of a seating with the outside of the body and configured such as to expel the air from the seating on the action of the pistons of the respective actuator, i.e. when the pistons move between the respective first and second position. In fact, the outward and/or return of an actuator between the advanced, intermediate and retracted positions causes a compression of the air in the seating, which if not expelled might function as a pneumatic spring and prevent the movement of the actuator (and thus prevent the movement of the corresponding command cam). The vents 75 enable expulsion of air in these conditions and are preferably two in number for each actuator, the first vent located downstream of the first piston of the actuator (and upstream of the second piston), and the second vent advanced axially with respect to the first and positioned (immediately) downstream of the second piston.

Each vent 75 preferably comprises a respective filter 76 (preferably housed in the vent) able to retain oil, metal residues, dust particles etc., preventing these impurities from entering the respective seating through the vent. The filters 76 can be carbon filters.

The vent preferably has a greater diameter than or equal to 1 mm and/or 3 mm and/or 5 mm and/or 7 mm. The presence of the filter enables realizing a vent of large dimensions, which effectively realizes the exit of the air without enabling inlet of impurities internally of the body.

In a possible embodiment, not illustrated, each actuator comprises a first sensor associated to the piston and/or a second sensor associated to the second piston. Each sensor is configured to detect the change of state of the respective piston (i.e. the passage between the first and the second position of the piston), i.e. to verify that on actuation of the piston due to the respective solenoid valve, the piston reaches the respective first or second position. Each sensor is preferably connected to the electronic board in such a way as to realize a closed command ring with the respective solenoid valve; when the solenoid valve activates or deactivates the piston, via the sensor the board verifies that the piston has effectively reached the end of the run thereof and has abutted in the second position thereof or, vice versa, that the piston has effective reached the opposite end run thereof and has abutted in the first position thereof. In a case of fault or malfunctioning (for example of the solenoid valve or the piston), the sensor enables detecting the fault and the electronic board can block the device or the machine and/or predispose appropriate alarm signals.

In the following a particular aspect of the present invention is developed, relating to the body of the mobile cam device for commanding the needles of a knitting machine.

As described above, and visible in particular in FIGS. 5, 6*a*, 6*b* and 6*c*, the body 2 of the device is provided with at least a first housing seating 4*a* having a longitudinal development and configured to movably house at least a first actuator 5*a*, which actuates the first command cam 8*a*. The first actuator comprises a first piston 15*a* and a second piston 16*a* distinct from one another and translatably housed, in series, in the first seating; the two pistons of the actuator are actuable independently from one another.

As shown by way of example in the figures, the peculiarity of the body 2 of the present invention is that it is one alone for the whole device (i.e. not made up of distinct parts assembled to one another): the body 3 is realized in a single piece, i.e. it is a single-block body.

As described above, the first seating 4*a* is provided with a first bottom end 11, open on the rear side 41 of the body, and a second head end 12, opposite the bottom end and open on the front side 42 of the body, destined to be facing towards the needles of the knitting machine. The bottom end 11 enables inserting the second piston 16*a* and the first piston 15*a* in succession, while the head end 12 enables inserting, at least partially, the engaging portion 81*a* of the first command cam 8*a*.

As described above, each of the two pistons is translated selectively into the first seating between a first position (retracted) and a second position (advanced), with respect to the longitudinal development of the first seating from the bottom end to the head end.

As shown by way of example in the figures, the first seating 4*a* exhibits a non-decreasing section (i.e. narrowly growing or made up of tracts in which the section grows (for example step-increases and constant-section tracts) from the head end 12 to the bottom end 11, and does not exhibit undercuts from the head end to the bottom end. The first seating preferably exhibits a tapered section from the bottom end to the head end.

In greater detail, the first seating 4*a* advantageously exhibits, in series, from the bottom end to the head end, a second section 102 and a third section 103, strictly decreasing and preferably circular.

The first section 101 preferably exhibits a first diameter, the second section 102 exhibits a second diameter, smaller than the first diameter, and the third section 103 exhibits a third diameter, smaller than the second diameter.

The first seating 4*a* preferably exhibits a first abutment (or first abutting section 41*a*, defined above) between the first and the second section and a second abutment (or second abutting section 42*a*, defined above) between the second and the third section. The first and the second abutments define the endruns for the advancing movement respectively of the first piston and the second piston, from the respective position to the respective second position.

As shown by way of example in the figures, the first piston 15*a* preferably comprises a rear portion 24*a* and a front portion 25*a* solidly constrained to one another and developing in series along a longitudinal axis of the first piston; the front portion 25*a* is downstream of the rear portion 24*a* when the piston is inserted in the seating. The rear portion receives a thrust from the compressed air flow which supplies the first piston (by means of the first air pathway), while the front portion axially transmits the thrust downstream of the first piston (towards the second piston).

The first piston is preferably inserted in the first seating in such a way that the longitudinal axis thereof is coaxial with the longitudinal development of the seating.

As shown by way of example in the figures, the rear and front portions of the first piston have a cylindrical conformation, the rear portion having a diameter that is substantially equal to the first diameter and the front portion having a diameter that is substantially equal to the second to diameter. The first piston thus exhibits a step between the rear portion and the front portion, the step being substantially complementarily shaped to the first abutment 41*a*.

The second piston 16*a* comprises a respective rear portion 26*a* and a respective front portion 27*a* solidly constrained to one another and developing in series along a longitudinal axis of the second piston; the front portion is downstream of the rear portion when the piston is inserted in the seating. The rear portion receives a respective push from the flow of compressed air which supplies the second piston (between the second air pathway) while the front portion axially transmits the push downstream of the piston (towards the command cam).

As shown by way of example in the figures, the second piston 16*a* is inserted in the first seating such that the longitudinal axis thereof is coaxial with the longitudinal development of the seating and, additionally, with the respective longitudinal axis of the first piston.

The rear portion 26*a* and the front portion 27*a* of the second piston 16*a* preferably have a cylindrical conformation, the rear portion having a diameter that is substantially equal to the second diameter and the front portion having a diameter that is substantially equal to the third diameter. The second piston therefore exhibits a respective step between the rear portion and the front portion, the step being substantially complementarily-shaped to the second abutment 42*a*.

The front portion 25*a* of the first piston 15*a* and the rear portion 26*a* of the second piston 16*a* preferably have the same diameter, substantially equal to the second diameter of the seating, and when the second piston is in the first position thereof, are in contact with one another, i.e. with a rear surface of the second piston headed abuttingly on the above-cited head surface of the first piston.

As can be seen by way of example in the figures, the front portion of the first piston terminates with the above-mentioned head surface and the front surface of the second piston exhibits the above-mentioned front engaging portion (for assembling the command cam).

The first piston 15*a* preferably comprises a first seal 111 wound about the rear portion 24*a* such as to be interposed between it and the first section 101 of the seating 4*a* and to realise an air seal between the first piston and the first section of the seating both statically and during the translation of the piston.

The first piston 15*a* preferably comprises a second seal 112 wound about the front portion 25*a* such as to be interposed between it and the second section 102 of the seating 4*a* and to realise an air seal between the first piston and the second section of the seating both statically and during the translation of the piston.

The second piston 16*a* preferably comprises a respective first seal 113 wound about the respective rear portion 26*a* in such a way as to be interposed between it and the second section 102 of the seating and to realize an air seal between the second piston and the second section of the seating both statically and during the translation of the piston.

The second piston 16*a*, if for example a pneumatic spring were present for the return of the piston, preferably comprises a respective second seal (not illustrated) wound about the respective front portion 27*a* such as to be interposed between the rear portion 27*a* and the third section 103 of the seating and realizing an air seal between the second piston and the third section of the seating both statically and during the translation of the piston.

The first actuator is preferably provided with means for directly mounting the first cam to the first actuator. The mounting means comprise a screw (possibly provided with a flat or elastic washer) insertable in a hole of the second piston and engaging a threaded hole realized in the engaging portion of the first cam, such as to solidly constrain the first cam to the second piston, preferably coaxially.

In an aspect the hole in the second piston is a through-hole between the rear portion and the front portion, and the screw is insertable in the hole from the side of the rear portion of the piston such that the screw head is accessible from the rear portion and the screw stem exits from the front portion so as to screw into the threaded hole of the cam.

The operating configurations (retracted, intermediate, advanced) which can be assumed by the first actuator are the same as already described above and illustrated in FIGS. 6*a*, 6*b* and 6*c*.

Note, as illustrated above, that the body 2 of the device of the present invention can further comprise, according to the needs of the knitting machine to which the device 1 is destined, also a second actuator 5*b* and possible a third actuator 5*c* and a fourth actuator 5*d*. The embodiment shown by way of example in the figures exhibits a body provided with four distinct seatings (4*a*, 4*b*, 4*c* and 4*d*) for four actuators each actuating a respective command cam. The reference numbers used for like elements of the various actuators (with a respective seating, command cam, etc.) are the same, adding the letter "a" for the first actuator, the letter "b" for the second actuator, the letter "c" for the third actuator and the letter "d" for the fourth actuator.

The body 2 of the present invention, characterised by being realised in a single body, enables providing a peculiar method for realizing a mobile cam device for commanding the needles of a knitting machine. This method comprises steps of:

- predisposing the body 2;
- predisposing at least a first command cam 8*a;*
- predisposing at least a first actuator provided with the respective first and second piston;
- inserting the piston from the bottom end of the second piston, such that it is housed translatably to in the seating;
- at least partially inserting, in the head end of the seating, the engaging portion of the first command cam, and mounting the engaging portion to the second piston, such as to solidly constrain the first cam to the second piston;
- inserting the first piston from the bottom end of the seating, such that it is translatably housed in the seating and is arranged in series to the second piston along the longitudinal extension of the first seating;
- selectively and independently actuating the first and the second piston of the first actuator such as to command the movement of the first command cam (between the retracted, intermediate and advanced configurations).

The invention as it is conceived is susceptible to numerous modifications and variants, all falling within the scope of the inventive concept, and the mentioned components are replaceable by other technically-equivalent elements.

The invention attains important advantages.

First and foremost the invention enables obviating at least some of the drawbacks of the prior art. Further, the device of the present invention has a simple and rational structure and enables effectively obtaining the knitting functions required of knitting machines (both new and already existing), in particular by precision in moving the needle command cams of a front of a knitting machine.

The device of the present invention advantageously enables improving the performance of a knitting machine, in particular increasing the production velocity of the stitch, increasing the textile productivity of the machine.

Further, the device of the present invention is versatile, modular and easily adaptable to the various knitting needs.

A further advantage of the device of the present invention is its ability to maintain the pneumatic circuits clean and free of contaminating substances.

Further, the device is more reliable, resistant to faults and characterised by a working life that is longer than that of the known devices.

Further, the device of the present invention requires less maintenance. The device of the present invention is further simple and/or sturdy and/or relatively inexpensive to realize.

The invention claimed is:

1. A mobile cam device (1) for commanding needles of a needle bed of a knitting machine, the device comprising:

a body (2) of the device provided with at least a first housing seating (4*a*) having a longitudinal extension and configured to movably house at least a first actuator (5*a*) in the body;

at least a first command cam (8*a*) movably mounted and connected to the body and configured to interact with at least a needle of a needle bed of a knitting machine;

at least a first actuator (5*a*), movably housed at least partially in said first housing seating (4*a*) in the body and configured to move in a controlled way said first command cam (8*a*), wherein the first actuator comprises a first piston (15*a*) and a second piston (16*a*) distinct from one another and translatably housed in the first seating, the first and second piston being arranged in series along said longitudinal extension of the first seating and being translatable independently with respect to one another, the body (2) of the device being one and only one, and being made in a single piece.

2. The device (1) of claim 1, wherein the first seating (4*a*) is provided with a first bottom end (11), open on a rear side (41) of the body (2), and with a second head end (12), opposite the bottom end and open on a front side (42) of the body (2), configured to be facing towards the needles of the knitting machine, the bottom end enabling insertion in succession of the second piston (16*a*) and first piston (15*a*) and the head end enabling at least partial insertion of an engaging portion (81*a*) of the first command cam, such that the engaging portion is connectable to the second piston (16*a*) and an operating portion (82*a*) of the first cam (8*a*) exits from the first seating (4*a*), on the front end (42) of the body, such as to cooperate with one or more needles of the needle bed of the knitting machine.

3. The device (1) of claim 1, wherein the first piston (15*a*) is selectively translatable in the first seating at least between a first position, in which it is retracted in the seating in correspondence of the bottom end (11), and a second position in which it is advanced in the first seating towards the head end (12), and wherein the second piston (16*a*) is housed in the first seating downstream of the first piston with respect to the longitudinal extension of the first seating from the bottom end to the head end, the second piston (16*a*) being selectively translatable in the first seating at least between a respective first position in which it is retracted in the seating and headed abuttingly on a head surface of the first piston (15*a*), and a respective second position in which it is advanced in the first seating with respect to the head surface of the first piston towards the head end.

4. The device (1) of claim 1, wherein the first seating (4*a*) exhibits a non-decreasing section from the head end (12) to the bottom end (11).

5. The device (1) of claim 1, wherein the first piston (15*a*) comprises a rear portion (24*a*) and a front portion (25*a*) solidly constrained to one another and developing in series along a longitudinal axis of the first piston, the front portion (25*a*) being downstream of the rear portion (24*a*) when the piston is inserted in the seating, the rear portion receiving a thrust from a compressed air flow which supplies the first piston, and the front portion (25*a*) axially transmitting the thrust downstream of the piston, and wherein the first piston (15*a*) is inserted in the first seating (4*a*) in such a way that the longitudinal axis thereof is coaxial with the longitudinal extension of the seating.

6. The device (1) of claim 1, wherein the second piston (16*a*) comprises a respective rear portion (26*a*) and a respective front portion (27*a*) solidly constrained to one another and extending in series along a longitudinal axis of the second piston, the front portion (27*a*) being downstream of the rear portion (26*a*) when the second piston is inserted in the first seating, the rear portion (26*a*) receiving a respective push from a respective compressed air flow supplying the second piston and the front portion (27*a*) axially transmitting the push downstream of the second piston, and wherein the second piston (16*a*) is inserted in the first seating such that the longitudinal axis thereof is coaxial with the longitudinal extension of the seating.

7. The device (1) of claim 1, wherein the first piston (15*a*) comprises a first seal (111) wound about the rear portion (24*a*) such as to be interposed between it and the first section (101) of the seating (4*a*) and to realise an air seal between the first piston and the first section of the seating both statically and during the translation of the piston.

8. The device (1) of claim 1, wherein the first actuator (5*a*) is configured such as to selectively operate at least among following operating configurations:

a retracted configuration, in which the first (15*a*) and the second piston (16*a*) are both in the respective first position, the engaging portion (81*a*) of the first cam (8*a*) being retracted in the first seating (4*a*);

an intermediate configuration, in which the first piston is in the respective second position and the second piston is in the respective first position, the engaging portion of the first cam being partially advanced in the first seating;

an advanced configuration, in which the second piston is in the respective second position and the engaging portion of the first cam is completely advanced in the first seating, while the first piston can be in the respective first position or in the respective second position.

9. The device of claim 1, further comprising a second actuator (5*b*) movably housed at least partially in a second housing seating (4*b*), the second actuator (5*b*) being configured to move in a controlled way a second command cam (8*b*) in turn configured to interact with at least a needle of a needle bed of a knitting machine, the second actuator comprising a respective first piston and a respective second piston having same characteristics as described in relation to the first actuator.

10. A method for realising a mobile cam device (1) for commanding needles of a needle bed of a knitting machine, the method comprising steps of:

predisposing a body (2) of the device provided with at least a first housing seating (4*a*) having a longitudinal extension and configured such as to movably house at least a first actuator (5*a*) in the body, the first seating (4*a*) being provided with a first bottom end (11), open on a rear side (41) of the body (2), and a second head end (12), opposite the bottom end and open on a front side (42) of the body (2), configured to be facing towards the needles of the knitting machine;

predisposing at least a first command cam (8*a*) configured to interact with at least a needle of a needle bed of a knitting machine;

predisposing a first actuator (5*a*) comprising a first piston (15*a*) and a second piston (16*a*) and configured to move in a controlled way the first command cam (8*a*);

inserting the second piston (16*a*) from the bottom end (11) of the first seating, such that the second piston (16*a*) is housed translatably in the seating;

at least partially inserting, in the head end (12) of the seating, an engaging portion (81*a*) of the first command cam (8*a*), and mounting the engaging portion to the second piston (16*a*), such as to constrain the first cam solidly to the second piston;

inserting the first piston (15*a*), from the bottom end (11) of the seating, so that it is translatably housed in the seating and is arranged in series to the second piston (16*a*) along the longitudinal extension of the first seating;

selectively and independently activating the first and second piston of the first actuator in order to command the movement of the first command cam.

11. The device (1) of claim 1, wherein the needle bed is a cylinder of a circular knitting machine.

12. The device (1) of claim 3, wherein the second piston (16*a*) of the first actuator (5*a*) is provided with a front engaging portion (17*a*) to which the engaging portion (81*a*) of the first command cam is configured to be solidly connected, such that the translation of the first and/or second piston of the first actuator determines a corresponding translation of the first command cam in entry and in exit from the first seating.

13. The device (1) of claim 4, wherein the first seating does not exhibit undercuts from the head end to the bottom end.

14. The device (1) of claim 4, wherein the first seating (4*a*) exhibits in series, from the bottom end to the head end, a first section (101), a second section (102) and a third section (103), strictly decreasing.

15. The device (1) of claim 4, wherein the first section (101) exhibits a first diameter, the second section (102) exhibits a second diameter smaller than the first diameter, and the third section (103) exhibits a third diameter smaller than the second diameter, and wherein the first seating exhibits a first abutment (41*a*) between the first (101) and the second section (102) and a second abutment (42*a*) between the second (102) and the third section (103), the first and second abutments defining endstops for advancing movement respectively of the first piston (15*a*) and the second piston (16*a*), from the respective first position to the respective second position.

16. The device (1) of claim 5, wherein the rear and front portions of the first piston have a cylindrical conformation, the rear portion (24*a*) having a diameter that is substantially equal to the first diameter and the front portion (25*a*) having a diameter that is substantially equal to the second diameter, the first piston (15*a*) exhibiting a step between the rear portion and the front portion, the step being substantially complementarily shaped to the first abutment (41*a*).

17. The device (1) of claim 6, wherein the rear and front portions of the second piston have a cylindrical conformation, the rear portion (26*a*) having a diameter substantially equal to the second diameter and the front portion (27*a*) having a diameter that is substantially equal to the third diameter, the second piston (16*a*) exhibiting a respective step between the rear portion and the front portion, the step being substantially complementarily shaped to the second abutment (42*a*).

18. The device (1) of claim 7, wherein the first piston (15*a*) comprises a second seal (112) wound about the front portion (25*a*) such as to be interposed between the front portion (25*a*) and the second section (102) of the seating (4*a*) and to realise an air seal between the first piston and the second section of the seating both statically and during the translation of the piston.

19. The device (1) of claim 7, wherein the second piston (16*a*) comprises a respective first seal (113) wound about the respective rear portion (26*a*) in such a way as to be interposed between the rear portion (26*a*) and the second section (102) of the seating and to realize an air seal between the second piston and the second section of the seating both statically and during the translation of the piston, and/or wherein the second piston (16*a*) comprises a respective second seal wound about the respective front portion (27*a*) such as to be interposed between the front portion (27*a*) and the third section (103) of the seating and realizing an air seal between the second piston and the third section of the seating both statically and during the translation of the piston.

20. The device (1) of claim 9, wherein the device comprises a third and/or a fourth actuator, identical or equivalent to the first actuator, housed in a third seating (4*c*) and/or in a fourth seating (4*d*) of the body (2) and configured to move in a controlled way a third (8*c*) and/or a fourth command cam (8*d*).

* * * * *